US011401077B2

(12) United States Patent
Mollick

(10) Patent No.: US 11,401,077 B2
(45) Date of Patent: Aug. 2, 2022

(54) PLASTIC BAG WITH VISIBLE DISTINGUISHABLE CHARACTERISTICS

(71) Applicant: Peter Joseph Mollick, Phoenix, AZ (US)

(72) Inventor: Peter Joseph Mollick, Phoenix, AZ (US)

( * ) Notice: Subject to any disclaimer, the term of this patent is extended or adjusted under 35 U.S.C. 154(b) by 15 days.

(21) Appl. No.: 17/094,437

(22) Filed: Nov. 10, 2020

(65) Prior Publication Data

US 2022/0063870 A1 Mar. 3, 2022

Related U.S. Application Data

(60) Provisional application No. 63/204,157, filed on Sep. 15, 2020, provisional application No. 63/204,046, filed on Sep. 8, 2020, provisional application No. 63/103,911, filed on Aug. 31, 2020, provisional application No. 63/103,819, filed on Aug. 26, 2020.

(51) Int. Cl.
*B65D 33/00* (2006.01)
*B65D 33/06* (2006.01)

(52) U.S. Cl.
CPC ..... *B65D 33/004* (2013.01); *B65D 33/001* (2013.01); *B65D 33/002* (2013.01); *B65D 33/065* (2013.01)

(58) Field of Classification Search
CPC .. B65D 33/004; B65D 33/001; B65D 33/002; B65D 33/065
USPC ..... 383/8, 37
See application file for complete search history.

(56) References Cited

U.S. PATENT DOCUMENTS

| | | | | | |
|---|---|---|---|---|---|
| 3,027,065 | A | | 3/1962 | Lindquist | |
| 3,180,557 | A | | 4/1965 | Thulin | |
| 3,482,761 | A | * | 12/1969 | Lindstrom | B29C 65/02 383/18 |
| 4,085,822 | A | * | 4/1978 | Osborn | A47F 9/042 53/385.1 |
| 4,273,549 | A | | 6/1981 | Francesco | |
| 4,464,157 | A | * | 8/1984 | Benoit | B31B 70/00 493/224 |
| 4,560,067 | A | | 12/1985 | Reimann | |

(Continued)

FOREIGN PATENT DOCUMENTS

| | | | | |
|---|---|---|---|---|
| EP | 0891932 A1 | * | 1/1999 | B65D 33/002 |
| GB | 2473599 A | * | 3/2011 | B41M 3/006 |
| WO | WO-2007072030 A2 | * | 6/2007 | B65D 33/001 |

*Primary Examiner* — Jes F Pascua

(57) ABSTRACT

The present invention relates to modern plastic shopping bags. The shopping bag comprises two opposing handles, a main body with opposing sides, an open top, and a closed bottom. The shopping bag handles comprises a distinguishing characteristic on all of or a portion of each handle, thereby making each handle significantly visibly distinguishable from the main body of the shopping bag. Additionally proposed is a group of shopping bags for mounting to a dispenser rack, and wherein the handles characteristic of each first bag in line to be removed from the dispenser in succession differs from the handles characteristic of the next bag in line to be removed from the dispenser. In addition to the handles characteristic being significantly visually identifiable from the main body characteristic, other identifiable features of the bag such as a displayed Universal Product Code (UPC) are also shown and displayed.

42 Claims, 22 Drawing Sheets

(56) References Cited

U.S. PATENT DOCUMENTS

| | | | | | |
|---|---|---|---|---|---|
| 4,597,749 | A * | 7/1986 | O'Brien | B65D 33/065 | 493/926 |
| 4,793,539 | A * | 12/1988 | Haenni | B65H 35/008 | 225/106 |
| 4,819,806 | A | 4/1989 | Pistner | | |
| 4,877,473 | A | 10/1989 | Snowdon | | |
| 4,911,872 | A * | 3/1990 | Hureau | B65D 29/04 | 383/17 |
| 5,020,750 | A | 1/1991 | Vrooman | | |
| 4,989,732 | A | 2/1991 | Smith | | |
| 5,087,234 | A | 2/1992 | Prader | | |
| 5,182,895 | A * | 2/1993 | Lugo | A45C 3/04 | 383/7 |
| 5,183,158 | A | 2/1993 | Boyd | | |
| 5,209,371 | A * | 5/1993 | Daniels | A47F 13/085 | 225/106 |
| 5,562,580 | A | 10/1996 | Beasly | | |
| 5,950,818 | A * | 9/1999 | Paulsen | B65D 83/0805 | 206/823 |
| 6,068,584 | A * | 5/2000 | Daniels | B65D 33/004 | 383/127 |
| 10,702,050 | B1 | 7/2020 | Hames | | |
| 2004/0016656 | A1* | 1/2004 | Goldenberg | A47G 25/56 | 206/390 |
| 2004/0184682 | A1* | 9/2004 | Lovold | B65D 33/007 | 383/35 |
| 2005/0144027 | A1* | 6/2005 | Brunner | B65D 33/004 | 705/1.1 |
| 2011/0203961 | A1* | 8/2011 | Reyes | B65D 33/06 | 206/459.5 |
| 2014/0314340 | A1* | 10/2014 | Wilfong | B65D 33/00 | 493/194 |
| 2015/0239617 | A1 | 8/2015 | Verdekal | | |
| 2020/0239194 | A1* | 7/2020 | Yosufy | B65D 33/1683 | |

* cited by examiner

PLASTIC BAG WITH VISIBLE DISTINGUISHABLE CHARACTERISTICS

CROSS-REFERENCE TO RELATED APPLICATIONS

This application claims the benefit of U.S. Provisional Patent Application No. 63/103,819 titled "Color Identifyed grocery bag" filed Aug. 26, 2020 and U.S. Provisional Patent Application No. 63/103,911 titled "Grocery bag and system with color identifiable handles" filed Aug. 31, 2020 and U.S. Provisional Patent Application No. 63/204,046 titled "Grocery bag with identifiable attributes" filed Sep. 8, 2020 and U.S. Provisional Patent Application No. 63/204,157 titled "Plastic bag with visually identifiable characteristics" filed Sep. 15, 2020, the contents of which are incorporated herein by reference in their entirety.

BACKGROUND OF THE INVENTION

Field of the Invention

This invention relates to thermoplastic bags commonly used as shopping bags in grocery stores, the bags are manufactured from a tubular thermoplastic structure comprising handles formed integrally in the tubular structure that forms the main body of the bag. The plastic shopping bags are sometimes called T-Shirt bags.

Description of Related Art

Plastic shopping bags, carrier bags, or plastic grocery bags are a type of plastic bag used as shopping bags and made from various kinds of plastic. In use by consumers worldwide since the 1960s, these bags are sometimes called single use bags, referring to carrying items from a store to a home. However, reuse for storage or trash is common, and modern plastic shopping bags are increasingly being recycled. In recent decades, numerous countries have introduced legislation restricting the sale of plastic bags, in a bid to reduce littering and plastic pollution. Some reusable shopping bags are made of plastic film, fibers, or fabric.

American and European patent applications relating to the production of plastic shopping bags can be found dating back to the early 1950s, but these refer to composite constructions with handles fixed to the bag in a secondary manufacturing process. The modern lightweight shopping bag is the invention of Swedish engineer Steen Gustaf Thulin. In the early 1960s, Thulin developed a method of forming a simple one-piece bag by folding, welding and die-cutting a flat tube of plastic for the packaging company Celloplast of Norrkoping, Sweden. Thulin's design produced a simple, strong bag with a high load-carrying capacity, and was patented worldwide by Celloplast in 1965. As his son Raoul said later, Sten believed that durable plastic bags will be not single-use but long-term used and could replace paper bags which need chopping of trees. The US petrochemicals group Mobil overturned Celloplast's US patent in 1977. Another prior art patent is U.S. Pat. No. 5,562,580 Beasley, et al. titled "self opening polyethylene bag stack and process for producing same". This referenced patent contains much of the prior art of the currently disclosed invention while not addressing identifying color attributes of the bags.

From the mid-1980s onwards, plastic bags became common for carrying daily groceries from the store to vehicles and homes throughout the developed world. As plastic bags increasingly replaced paper bags, and as other plastic materials and products replaced glass, metal, stone, timber and other materials, a packaging materials war erupted, with plastic shopping bags at the center of highly publicized disputes.

In 1992, Sonoco Products Company of Hartsville, S.C. patented the "self-opening polyethylene bag stack." The main innovation of this redesign is that the removal of a bag from the rack opens the next bag in the stack via a minimal adhesive placed between the bags on a tab at the center-top. This team was headed by Wade D. Fletcher and Harry Wilfong. This design and later variations upon it are commonplace through modern grocers, as they are space-efficient and customer-friendly.

Prior art of plastic grocery bags currently in use in the marketplace comprise handles that are not significantly visually distinguishable from the main body of the plastic bag. The handles of the plastic bag can sometime be hard to locate or identify as they blend in with the main body of the plastic bag. In some cases, the main body of the plastic bag is semi-transparent and the handles are semi-transparent, thus, requiring the end user to spend more time than he or she reasonably should be looking and feeling for the plastic bag handles, and in cases where many plastic bags are located next to each other, grabbing two handles wherein one handle belongs to one bag and the other handle belongs to another bag causing the end user to start over looking for the correct handles to grab.

Many plastic grocery bags in the marketplace are typically semi-transparent with no color or semi-transparent with color added such as brown or green, these bags are typically not easy to see clearly through, but the products in the bag can be seen, and the bags allow light to shine through the plastic film. Solid color bags are also an alternative to the semi-transparent bags. Many of the plastic grocery bags are semi-transparent in one color such as light brown throughout the entire bag including the handles with additional ink marking of a different color than the bag color inked across the main body of the bag. The ink coloring is usually an advertisement or simply the words "thank you!" being inked onto the front side of the bag main body.

BRIEF SUMMARY OF THE INVENTION

The disclosed invention improves the usability of the modern lightweight shopping bag used in the marketplace today, such as the plastic bags used as shopping bags in grocery stores. The modern lightweight shopping bag is a simple, strong bag with a high load-carrying capacity, and handles formed integrally in and from the main body of the bag. The design of the integral developed handles and tubular shape of the main body creates an efficient and economical shopping bag unlike other types of plastic bags that comprise externally attached handles. The modern lightweight shopping bags are efficiently and economically produced in large quantities in manufacturing of the bags. In one step of manufacturing the bag, the structure is flattened and each end is sealed. In a following step, at and near one end of the structure, portions of the structure are removed forming two opposing handles and a mouth opening in the structure, a portion of the sealed area remaining completing the handles.

The object of the disclosed invention is displaying identifiable characteristics on the bag that improve the ease of use of the bag. Many of the disclosed identifiable characteristics of the invention can be applied during manufacturing of the bag. The plastic bags are designed to be used in a retail merchandising sales environment, and mainly to be used as a group of plastic bags arranged to be dispensed from a dispenser. The group of bags in the dispenser assists the end user to place products in the bag by holding the bag upright and open, as well as causing the current bag being dispensed to automatically open the next bag in succession in the dispenser as the dispensed bag is being removed from the dispenser. To allow the full and effective use of the disclosed plastic bag in a retail merchandising sales environment, an arranged group of bags and a proper bag dispenser should be used to assist the end user in the proper and efficient placement of products into the bag. For additional efficiency of bagging products in a retail merchandising sales environment, there may be multiple open bags available to the end user, each bag residing in a separate dispenser rack, thus, comprising a group of stacked bags with one bag in the group being in an open position, allowing the end user to place all of the desired products into bags before picking them up or placing them in a cart to carry out of the store. In addition, a cluster of bags can be used in a dispenser rack holding multiple rolled bags that are not open at the mouth. Current retail sales environments are currently deploying the above-mentioned cluster of stacked bags method comprising a group of stacked bags comprising an open bag in each group of stacked bags for bagging products by the end user or by a sales cashier.

One of the main objects of the disclosed invention is the use of handles that are significantly visually distinguishable from the main body of the bag, therefore assisting the end user to easily locate the handles of a particular bag to grab one pair of bag handles at a time. In addition to identifiable paired handles on the bag, other characteristics are also shown such as a displayed numeral in conventional numbers, displayed Braille numbers, and a displayed Universal Product Code (UPC) bar code. In another version of the disclosed invention wherein multiples of plastic bags full of products are present and placed closely next to each other in a bunch after dispensing the bags from a dispenser, the disclosed invention proposes a system of bagging products wherein each pair of handles are identifiable and distinct from all or most other pairs of handles in the bunch of open bags, allowing the end user to easily grab individual or multiple sets of plastic bag handles at the same time while reducing the chance that any plastic bag is grabbed by only one handle. Generally, bunches of 10 or less bags will have handles that are identifiable and distinct from every other pairs of handles in the bunch, but as the quantity of bags in the bunch increases, separated paired handles of the same characteristic may be included in the bunch of bags without diminishing the advantages of the invention. Wherein the duplicate paired handles of different bags in the bunch of bags will generally be placed a short distance from another in the bunch of bags, making those identical different paired handles identifiable as a separate pair of handles from the other identical pair of handles. A further object of the invention, are plastic bag handles with a characteristic identifiable to a visually impaired person such as a blind or color-blind person, and yet still another version of the invention comprises marking on the bag such as a Universal Product Code (UPC) that can be scanned and identified by a scanner.

Although plastic bags currently in use in the marketplace serve a useful purpose and an affordable alternative to paper bags, plastic grocery bags have a few shortcomings in their efficient use. Three instances of current problematic instances the disclosed invention assists in resolving are described below.

In a first instance, one noticeable shortcoming is when the end user pulls a plastic bag off of a roll of plastic bags and attempts to open the mouth of the bag to insert product into the bag. The first thing that must be accomplished after removing the bag from the roll of bags is to locate the correct end of the bag where the mouth is located. The mouth end to open is always at the end of the bag where the handles are close to. The handles of the prior art bags are normally the same color as the main body of the bag, thus requiring close observation of the correct end where the handles are located. The handles main identifiable attribute of an unopened bag is two appendages hanging off of the bag, after the bag is opened; in this case, the apertures in the handles are visible. After removing a plastic bag from the roll, the handles of the bag may be hanging away from the main body of the bag or they may be folded over and laying close against the main body of the bag. If the handles are folded over against the main body of the bag, the identification of the handles and the mouth of the bag is a little more time consuming. Some plastic grocery bags have an arrow pointing to the correct end of the bag to open, but many of the bags do not have the arrow. After locating the handles and the mouth of the bag, then the act of trying to separate the plastic sides of the bag at the mouth of the bag in order to insert product into the bag must be accomplished. The separating of the plastic sides and opening the bag can be challenging when using dry fingers on a slippery plastic bag, adding to the frustration of using plastic grocery bags.

In a second instance, a noticeable shortcoming is when the prior art plastic grocery bag is filled with product and the bag is to be removed from a dispenser rack where the bag is held and positioned upright and the handles of the bag are at the top of the bag. The handles are not immediately recognizable since the handles are the same color as the main body of the bag and the handles may be laying along the side of the bag, or laying against other bags of the same color in the dispenser rack, in effect the handles must be closely looked for to identify and grab a hold of to remove the bag from the dispenser rack.

In a third instance, a noticeable shortcoming is after grocery product has been inserted into many prior art bags during purchase of products at a grocery store. The bags are many times bunched together at the end of the checkout counter near the end of the cashier conveyor belt, the bags must be then grabbed by the handles and placed into a shopping cart or simply carried out of the store to be transported to their final destination. The problem arises in trying to find the correct two handles of one bag of the bunch of bags when looking at multiple bags with two handles each, and wherein all of the bag handles and bag main bodies are the same color or similar in color. Although it is possible to pickup more than one bag at a time when light grocery products are in the bags, usually one bag at a time is picked up and either put into a grocery cart or placed in the hands of the customer or end user for transport out of the store. The problem arises in separating the handles of multiple bags to find the two handles that belong to one individual bag. If any random two handles in the large bunch of bags and handles are picked up, there is a chance that one handle will belong to one bag and the other handle will belong to another bag. Upon grabbing two mismatched handles or two different bags and the following lifting of the two bags instead of lifting of only one bag, the result is each of the two bags are lifted by only one handle. In the one handle lifting scenario, each bag will ultimately shift sideways and possibly spill product from the bag, or in a worst case scenario, the one handle on each bag will tear, causing the bag and the grocery products to fall to the floor. Plastic grocery bags are generally designed to be lifted by both handles to support the weight of the products in the plastic bag.

The problems of the first, second, and third instances are much easier to overcome using the disclosed invention of characteristic identified plastic bag handles, the three scenarios the disclosed invention provides to the above instances are described below.

In the first instance, after pulling a plastic grocery bag off of the plastic bag roll, it is easier to see the handles of the bag when each handle comprises a characteristic on all of, or a portion of the handle, wherein the characteristic visibly contrasts with the visual surface appearance of the main body, thereby making the handles significantly visibly distinguishable from the main body, or in another description of the invention, wherein each handle comprises a characteristic on all of, or a portion of the handle, wherein the characteristic visibly contrasts with the visual surface appearance of the main body, and wherein each handle characteristic includes at least one of i) a color, ii) a color scheme, iii) a tint of a color, iv) a colored design with at least one of: a pattern; a letter; a numeral; an insignia; or v) any combination of the preceding characteristics thereby making the handles significantly visibly distinguishable from the main body. This makes it simpler for a person to instantly identify the correct end of the plastic bag to open. The first handle is identified with the same or similar characteristic as the second handle, and the handles are identifiable as a pair belonging to the same bag. In this situation, the end user does not have to look vigorously for the handles since the handles are significantly visually distinguishable from the rest of the plastic bag, reducing the time required to find the mouth of the plastic bag.

In the second instance, when removing a plastic grocery bag from a holding rack after the bag has been filled with product, color identifying handles on the plastic bag become very easy to see and identify, therefore saving the end user time and frustration of locating the handles of the plastic bag.

In the third instance, wherein each pair of bag handles in a bunch of multiple bags are visually identifiable as a pair and the identifying characteristic is visually distinct from every other plastic bag pair of handles on the grocery counter, the task of finding two handles that belong to one plastic bag becomes relatively easy.

In the instance the end user is visually impaired such as color-blind or blind in another sense (total loss of sight, tunnel vision etc.), visual identifying and Braille numerals can also be used in the disclosed invention to identify the plastic bag handles, and if preferable, identifying the plastic bag main body. In addition, patterns may be suitable as a handle characteristic for a color-blind user, although, in some instances a pattern may be hard to describe when communicating with another person on the identity of a particular bag, wherein a visually identifying numeral is easy to describe.

The disclosed plastic bag is typically constructed from a thermoplastic polymer material such as polyethylene or high-density polyethylene (HDPE). Typically the plastic shopping bags are semi-transparent-colorless or semi-transparent-colored, allowing the end user to generally see at least the shape of the products inside the bag. Solid-colored bags that are not semi-transparent are usually not used in grocery stores, although, the disclosed invention may use a semi-transparent main body of the bag and semi-transparent or solid colored handles, or if desired, the complete bag can be solid-multicolored if desirable. The disclosed plastic bag is a structure of plastic film comprising a first end, a second end, and a continuous surrounding sidewall, wherein the structure forms into a tubular shape having a width, a depth, and a height when the volume of the structure is filled with air or product, the structure forming into a flattened shape when empty and collapsed. In a possible and common step of manufacturing of the prior art bag, the structure is flattened and each end is sealed, in a following step, at and near the first end of the structure, two handle cutouts and a mouth cutout from the structure are removed forming two opposing loop handles, and a mouth opening in the structure, each handle comprising an aperture. The cutouts cut both the front and the back of the structure as the structure lays flat in a stack of multiple compressed tubular structures. The first end comprising a mouth and two opposing handles, the handles being a first handle and a second handle, each handle being a loop formed integrally in and of the structure, two apertures in the structure forming the two loop handles. The mouth opening of the structure is positioned between the first handle and the second handle for the entry of one or more products, the mouth opening and the handles being the top end of the bag, the opposing end of the first end being the second end and bottom end of the bag. The second end of the bag being closed and sealed for holding one or more products, the portion of the bag connecting between the first end and the second end is the main body of the bag. The bag is typically semi-transparent, although a solid colored bag is also an alternative. In the disclosed invention, each handle comprises a characteristic on all of, or a portion of the handle, wherein the characteristic visibly contrasts with the visual surface appearance of the main body, thereby making the handles significantly visibly distinguishable from the main body, or in another description of the invention, wherein each handle comprises a characteristic on all of, or a portion of the handle, wherein the characteristic visibly contrasts with the visual surface appearance of the main body, and wherein each handle characteristic includes at least one of i) a color, ii) a color scheme, iii) a tint of a color, iv) a colored design with at least one of: a pattern; a letter; a numeral; an insignia; or v) any combination of the preceding characteristics thereby making the handles significantly visibly distinguishable from the main body.

The first handle is identified with the same or similar characteristic as the second handle, thereby making the handles identifiable as a pair of handles on the same bag with the same or similar visual identifying properties allowing the two handles of one bag to be identifiable as belonging to a single bag when the bag is located next to multiple bags. A system for bagging products such as grocery products into the plastic bag is also shown and described in the disclosure.

Additional Considerations:

The visible characteristic of each handle may be provided on or in the material, which forms the handle.

There may be at least two different handle characteristics in a group of bags. For example, a first subgroup of the bags may have handles which include a first (i) a color, ii) a color scheme, iii) a tint of a color, iv) a colored design with at least one of: a pattern; a letter; a numeral; an insignia; or v) any combination of the preceding characteristics), and a second subgroup of bags may have handles which include a second (i) a color, ii) a color scheme, iii) a tint of a color, iv) a colored design with at least one of: a pattern; a letter; a numeral; an insignia; or v) any combination of the preceding characteristics).

The handle characteristic may include one or more of a i) a color, ii) a color scheme, iii) a tint of a color, iv) a colored design with at least one of: a pattern; a letter; a numeral; an insignia; or v) any combination of the preceding characteristics which is substantially absent from the main body of the bag.

The term tint is intended to include hue, shade, brightness and similar color properties, which allow for variations of the same color.

The handles are intended to contrast with, and differ significantly in their visual appearance from, the main body of the bag. There does not necessarily have to be a well-defined border between the handle characteristic and the main body, although such a border or immediate change of characteristic may be provided. Rather, the intention is for the handles to be different enough for a person to immediately see where the handles of the bag are (particularly as they are reaching for the handles, or about to do so), without the need for close inspection or prolonged consideration.

For example, the handles of a bag may be red, whilst the main body is transparent, translucent, white or another color that is not red. In another example, the handles may be reflective or shiny whilst the main body is not. The main body may be a neutral or dark color, whilst the handles are a bright or light color (or vice versa). The handles may exhibit particular patterns such as stripes or decorative designs that the main body does not exhibit. Other examples of contrasting characteristics will be evident to the skilled person and are also contemplated for the present invention.

BRIEF DESCRIPTION OF THE DRAWINGS

A better understanding of the present invention will be had upon reference to the following detailed description in conjunction with the accompanying drawings in which like numerals refer to like parts throughout the views herein.

DETAILED DESCRIPTION OF THE INVENTION

Reference Numerals

Figure 1A:
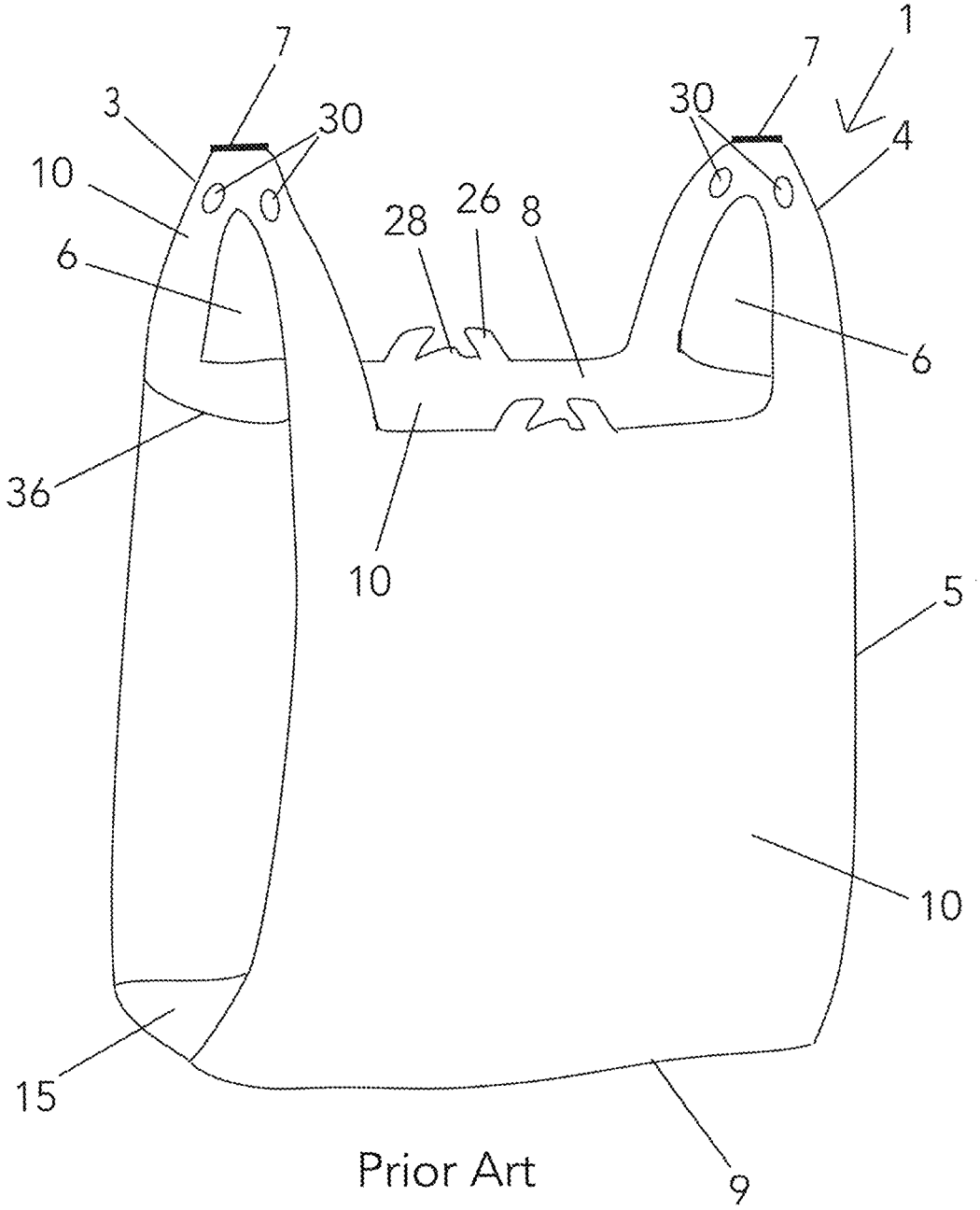
Prior Art FIG. 1a
FIG. 1*a* is a Prior Art perspective view of a plastic bag in the frontal view with a semi-transparent-colorless main body and matching semi-transparent-colorless handles.

For the convenience of the reader, the following is a list of reference numbers used in the description:

1 Thermoplastic plastic bag
2 Characteristic
2(*a*) Color
2(*b*) Color scheme: a particular combination of colors
2(*c*) Tint of a color
2(*d*) Colored design with at least one of: pattern; letter; numeral; insignia
2(*e*) Any combination of the preceding characteristics
3 First handle
4 Second handle
5 Main body
6 Aperture
7 Handle folds and overlaps
8 Mouth of the bag
9 Bottom seal

10 Semi-transparent-colorless
11 Semi-transparent-colored
12 Tactile Braille number
14 Handle numeral
15 Side gusset
16 Main body numeral
18 Dispenser rack
20 Rack supporting arm
22 Rack base
24 Roll pivot hole
26 Main body hanger
28 Bag pull-tab
30 Handle hanger hole
32 Mouth cutout
34 Universal Product Code (UPC)
36 Mouth rim
37 Bunch of open bags (generally means bags filled with air or product wherein the main body of the bags are expanded or open)
38 Group of stacked bags
40 Group of rolled bags
42 Cluster of stacked bags
43 Cluster of rolled bags
44 Product name
46 Company or corporation product identification number
48 Product picture
50 Subgroups of stacked bags
52 Subgroups of rolled bags FIG. 1*a* is a Prior Art perspective view of a plastic bag in the frontal view with a semi-transparent-colorless main body and matching semi-transparent-colorless handles. The handles 3+4 being the same color as the main body 5 and the handles comprising the same visual surface appearance as the main body 5. Shown are the handle apertures 6, the handles 3+4, the handle hanger holes 30, the handle fold and overlap 7, the main body hanger 26, the bag pull tab 28, the mouth of the bag 8, the bag bottom seal 9, the semi-transparent-colorless 10 of the main body 5 and the handles 3+4. In addition, one of the two gussets 15 is shown, showing the main body hanger 26 and the bag pull-tabs 28 on both the front and the rear of the bag sides, and the mouth rim 36 is shown on all sides of the bag 1.

Figure 1B:
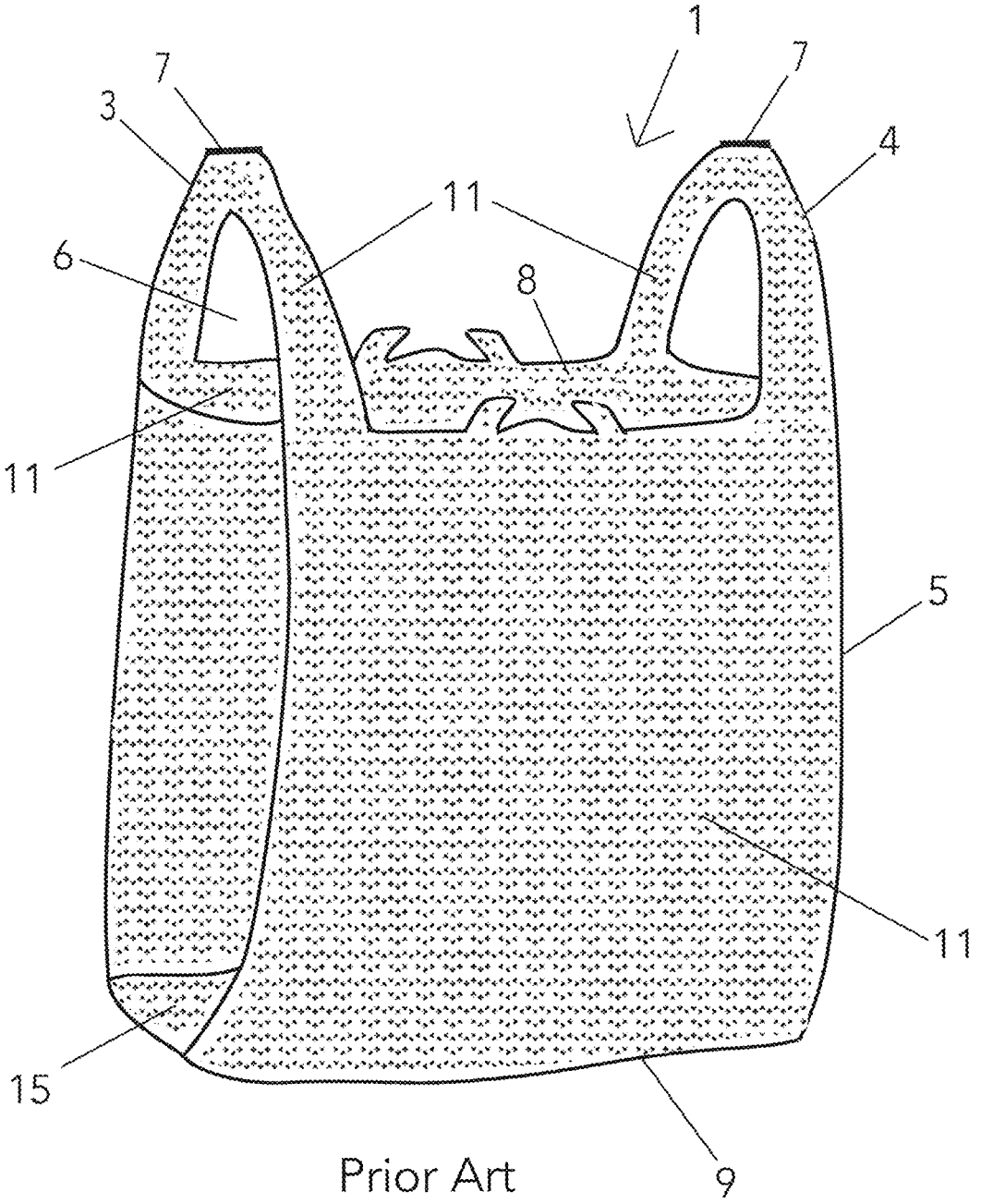
Prior Art FIG. 1b
FIG. 1*b* is a Prior Art perspective view of a plastic bag in the frontal view with a semi-transparent-colored main body and matching semi-transparent-colored handles.

FIG. 1*b* is a Prior Art perspective view of a similar bag to that of FIG. 1*a* that is showing the main body 5 as semi-transparent-colored 11 and the handles 3+4 matching in the same color as the main body 5, the handles comprising the same visual surface appearance as the main body 5, exemplifying the inability to quickly distinguish the handles from the main body 5 of the bag 1.

Figure 1C:
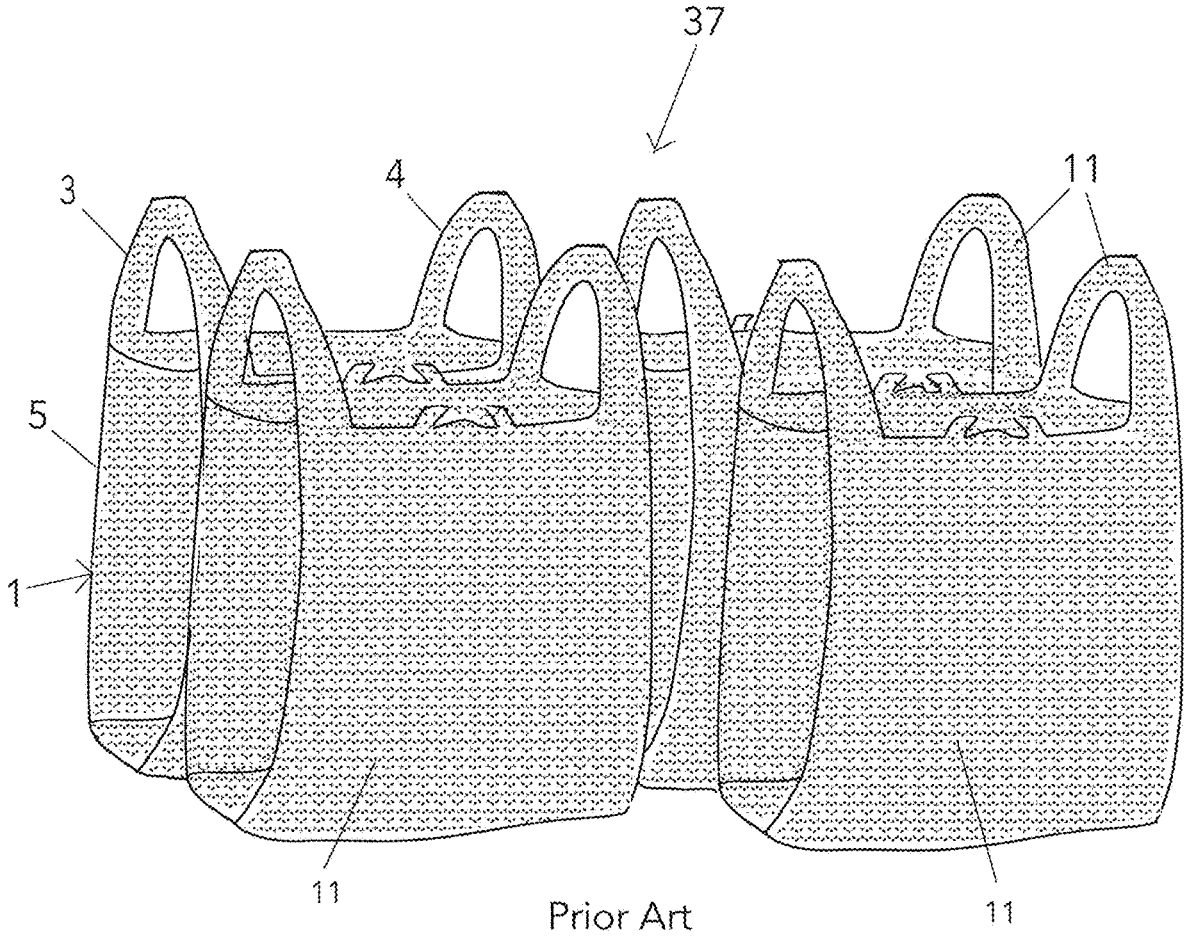
Prior Art FIG. 1c
FIG. 1*c* is a Prior Art perspective view of a bunch of plastic bags crowded together, the bags main body and handles being semi-transparent-colored and matching in color.

FIG. 1*c* is a Prior Art perspective view of a bunch of open bags 37 crowded together, showing the main bodies 5 as semi-transparent-colored 11 and the handles 3+4 matching in the same color, semi-transparent-colored 11, as the main bodies 5, the handles of each bag comprising the same visual surface appearance as the main bodies of each of the bags. The bunch of open bags 37 being bunched together can cause the handles 3+4 to also be bunched together making it difficult to distinguish the first handle 3 and the second handle 4 of the same bag 1. The handle colors 2(*a*) of both handles 3+4 on each bag 1 are of the same handle color 2(*a*) as every other pair of handles 3+4 in the bunch of open bags 37 and also the handles 3+4 are the same color as the main bodies 5 of every bag in the bunch of open bags 37. The handles 3+4 are not distinguished with a handle 3+4 characteristic 2 that is visually distinguished from the other bag 1 handles 3+4 in the bunch of open bags 37, nor are the bag 1 handles 3+4 of each bag visually distinguishable from the main body 5 of each bag 1, (see FIGS. 2*a* and 2*b*). If the end user were to grab two of the first handles 3+3 of two different bags 1+1, each of the two bags 1+1 may tip sideways when lifted, possibly spilling the products in the bags 1+1 to the floor. When grabbing a bag 1 from the prior art bunch of open bags 37, the end use must look carefully and distinguish the correct two handles 3+4 that make a pair in order to lift each bag 1 by both of the correct bag 1 handles 3+4 instead of only lifting each bag 1 by one handle 3.

Figure 2A:
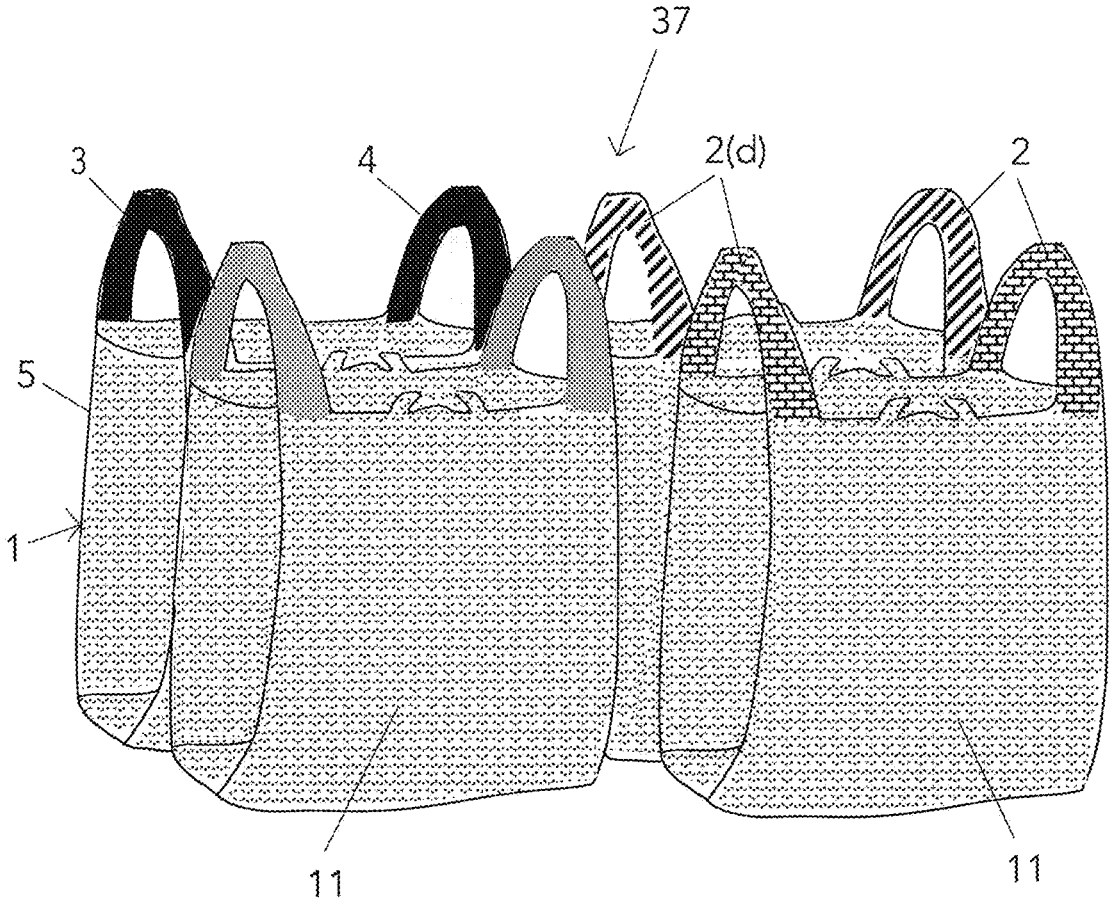
FIG. 2*a* is a perspective view of the disclosed invention on a bunch of open plastic bags crowded together showing identifiable pattern characteristics on each matching pair of handles, each matching pair of handles being different from the other pairs of handles.

FIG. 2*a* is a perspective view of the disclosed invention on a bunch of open bags 37 crowded together showing the handles 3+4 characteristic 2. The main body 5 is shown in semi-transparent-colored 11, the handles 3+4 being significantly visually distinguishable from the main body 5 of the bag 1 allowing the end user to easily grab one pair of handles 3+4 that belong to a particular bag 1. The bunch of open bags 37 can be the bags 1 of FIG. 2*a* or FIG. 2*b* wherein each bag 1 is close in proximity to at least one other bag 1 in the bunch of open bags 37, the handles 3+4 characteristic 2 of each bag 1 in the bunch of open bags 37 being significantly visually distinguishable from the handles 3+4 characteristic 2 of the other bags 1 in the bunch of open bags 37. Typically, during use, each bag 1 in the bunch of open bags 37 comprises one or more products inside the bag 1.

Figure 2B:
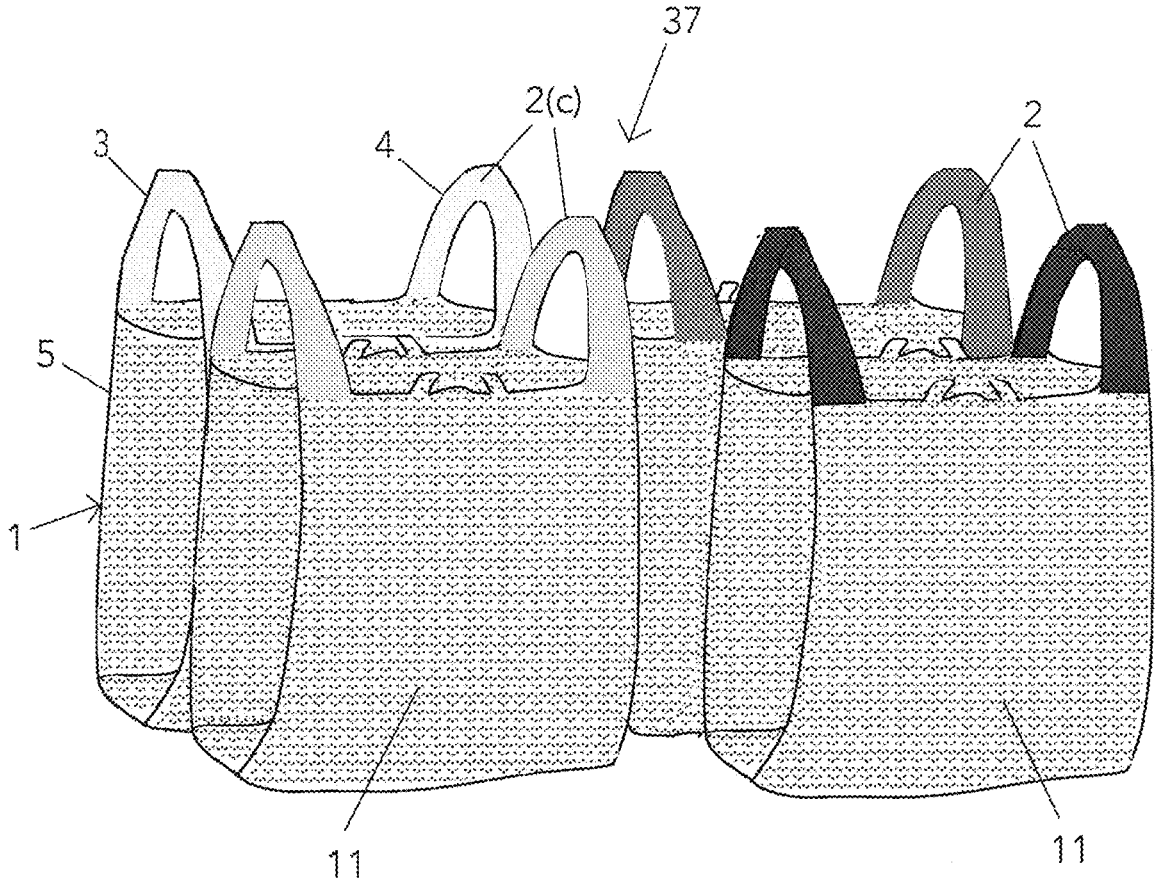
FIG. 2*b* is a perspective view of the disclosed invention on a bunch of open plastic bags crowded together showing identifiable colors on each matching pair of handles, each matching pair of handles being different from the other pairs of handles.

FIG. 2*b* is the same bunch of open bags 37 as FIG. 2*a* with the exception of the handles 3+4 characteristic 2 being a different type of the characteristic 2. For example, different tints 2(*c*) of the same color may be used in the different pairs of handles 3+4.

Figure 2C:
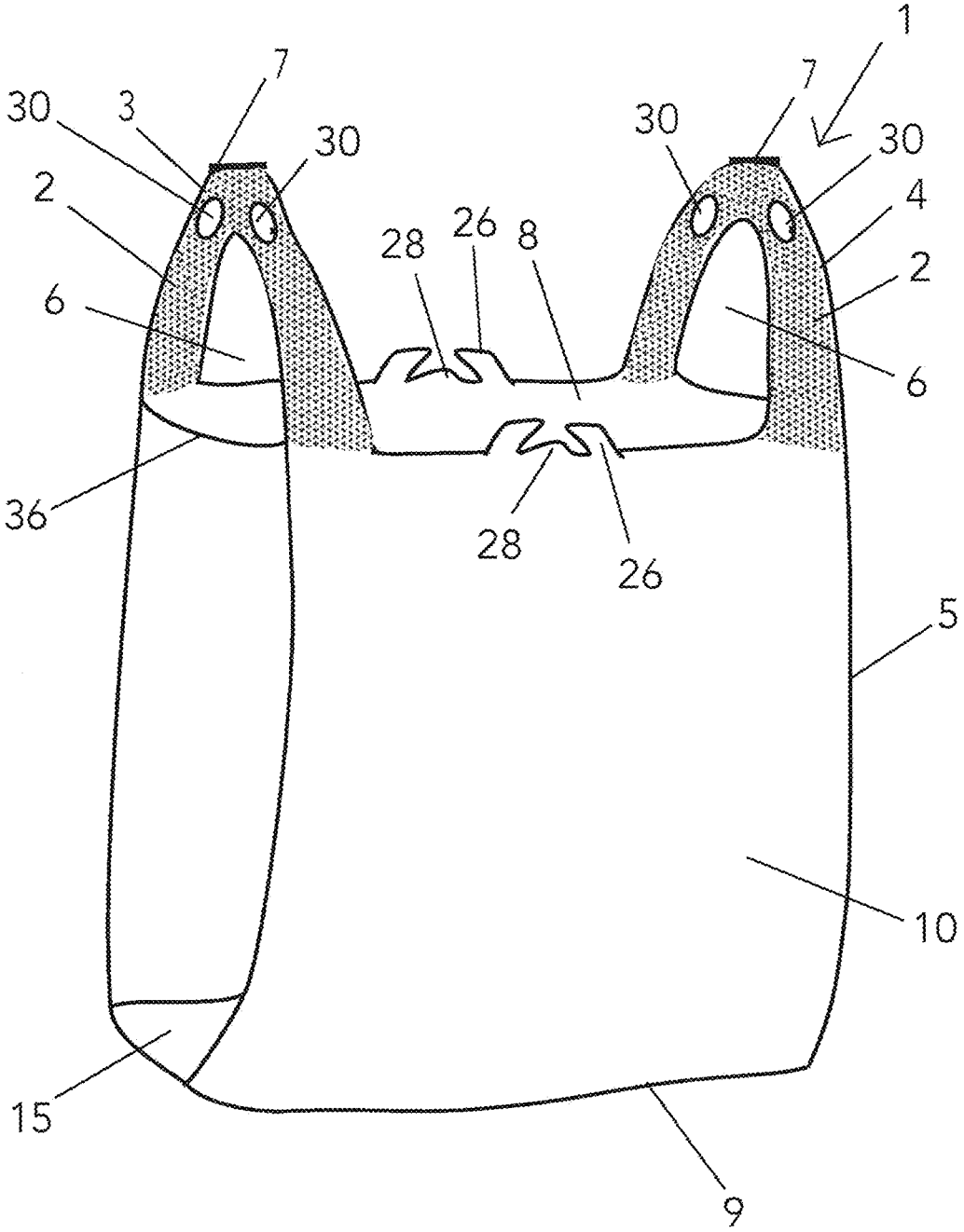
FIG. 2*c* is a perspective view of the plastic bag in the frontal view with a semi-transparent-colorless main body and color identifying handles.

FIG. 2*c* is a perspective view of the plastic bag 1 in the frontal view showing the handles 3+4 with the characteristic 2 on the first handle 3 and on the second handle 4. The main body 5 is shown with the bottom of the main body 5 having a bottom seal 9 that closes and seals the bottom of the plastic bag 1. The aperture 6 is shown inside the first handle 3 and the second handle 4, the first handle 3 and the second handle 4 being a loop and encircling the aperture 6 to provide a gripping surface to hold on to while lifting or carrying the plastic bag 1. The main body 5 of the plastic bag 1 is shown semi-transparent-colorless 10. The bag mouth 8 is shown placed between the two handles 3+4, the mouth rim 36 is shown near the top of the bag 1 and at the top of the mouth 8 of the bag 1, and the side gusset 15 is shown at the bottom of the bag 1. The side gusset 15 allows the bottom of the bag to form a semi-flat area with added strength to the bottom seal 9.

The main body hanger 26 is shown on the front and rear sides of the bag 1 and being attached to the mouth rim 36, the main body hanger 26 is also shown on the front and rear sides of the bag 1 and being attached to the mouth rim 36. The main body hanger 26 allows the main body 5 of the bag 1 to hang in the dispenser rack 18 (see FIG. 6), the main body hangers 26 of each bag 1 being bonded to each in the group of stacked bags 38 (see FIG. 8), forming a strong combined main body hanger 26 when the all of the bags 1 are in the group of stacked bags 38 and pressing against each other. The bag pull-tab 28 is shown on the front and rear sides of the bag 1 and being attached to the mouth rim 36, the bag pull-tabs 28 are also shown on the front and rear sides of the bag 1 and being attached to the mouth rim 36. The bag pull-tabs 28 in the group of stacked bags 38 are bonded to each other and they serve the function of opening the next successive bag 1 in the group of stacked bags 38 to be removed. As one bag 1 is being removed from the group of stacked bags 38, the rear bag pull-tab 28 pulls on the front bag pull-tab 28 of the next in line successive bag 1, therefore, opening the bag, as more force is applied to the bag 1 being removed in removing the bag 1 from the group of stacked bags 38 after the bag 1 is full of products, the bag pull-tabs 28 of the two bags 1 separate, separating the removed bag from the group of stacked bags 38. The handles 3+4 of the bag 1 comprises handle hanger holes 30 allowing the bag 1 to be supported in the dispenser rack 18 (see FIG. 6) and hung by the handles 3+4 of the bag 1. Each handle 3+4 comprising two handle hanger holes 30 for hanging the handles 3+4 on a dispenser rack 18 (see FIG. 6), thereby enabling both handles 3+4 to support the bag 1 in an upright position in the dispenser rack 18 (see FIG. 6). The handle folds and overlaps 7 are shown at the top of the handles 3+4. The plastic bag 1 can be constructed from thermoplastic film.

Figure 2D:
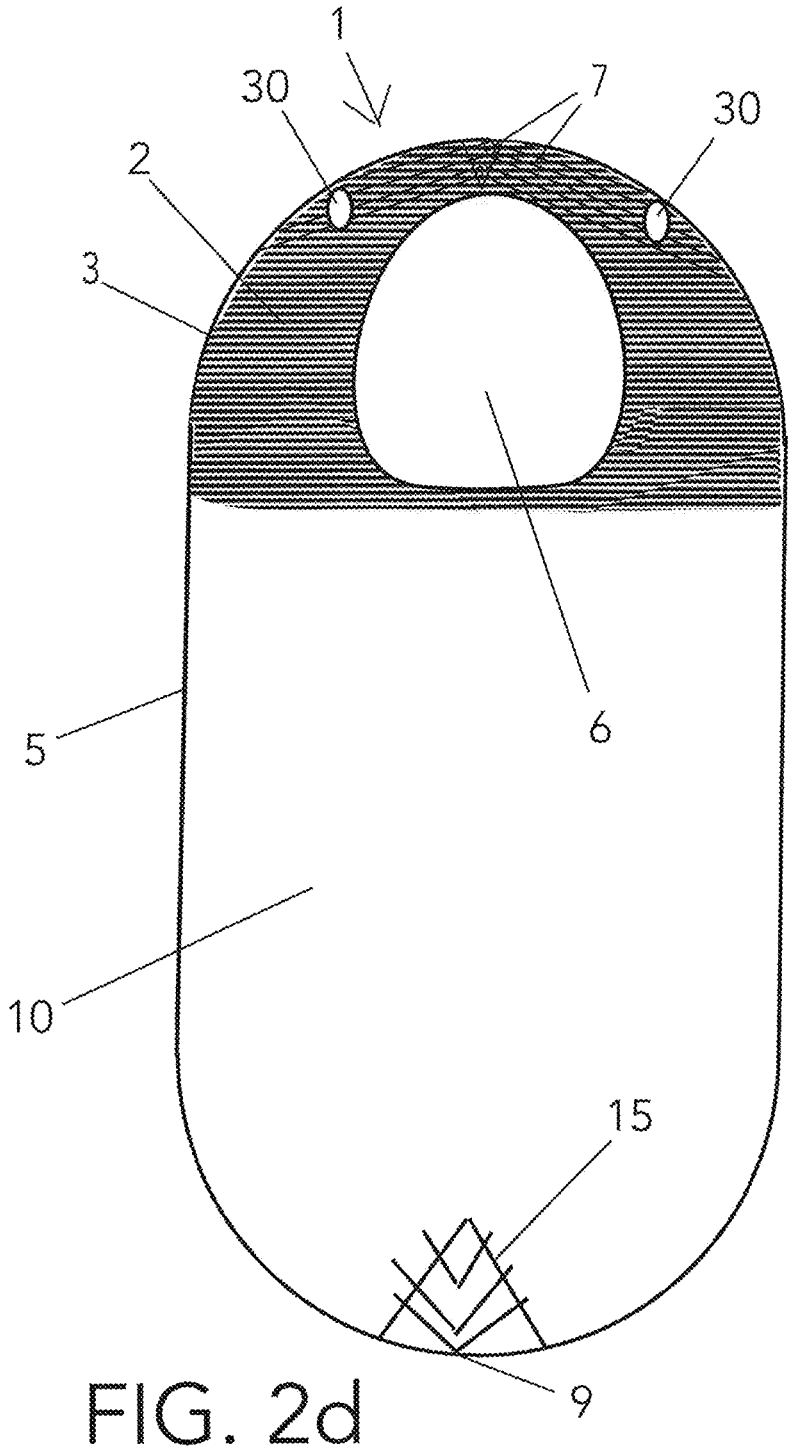
FIG. 2*d* is a side view of the plastic bag with a semi-transparent-colorless main body and color identifying handles.

FIG. 2*d* is a side view of the plastic bag 1 with a semi-transparent-colorless 10 main body 5 in plastic film. It shows the handles 3+4 and the characteristic 2 on the first handle 3, the characteristic 2 identifying the handle 3 significantly and making it visually distinguishable from the main body 5 of the bag 1, and the handle aperture 6 is shown in full expanded view after the handle 3 is unfolded, the aperture 6 being inside and encircled by the first handle 3. The first handle 3 encircling in shape and forming a loop to provide a gripping surface to hold on to while lifting or carrying the plastic bag 1. The top portion of the handle 3 is shown with handle folds and overlaps 7 of the plastic film while the handle is being gripped by an end user's hand. The bottom seal 9 of the bag main body 5 is shown with the bottom of the main body 5, the side gusset 15 is shown on the bottom of the bag 1 at the bottom seal 9 allowing the bag 1 to form a partially flat bottom of the main body 5. The bottom of the main body 5 can be a semi-flat bottom comprising two gussets 15. The first handle 3 is shown with two handle hanger holes 30 in the front and the back of the handle 3. The handle fold and overlaps 7 are shown spread out over the top of the handle 3 after the bag 1 and the handle 3 are opened up from the flattened arrangement.

Figure 3:
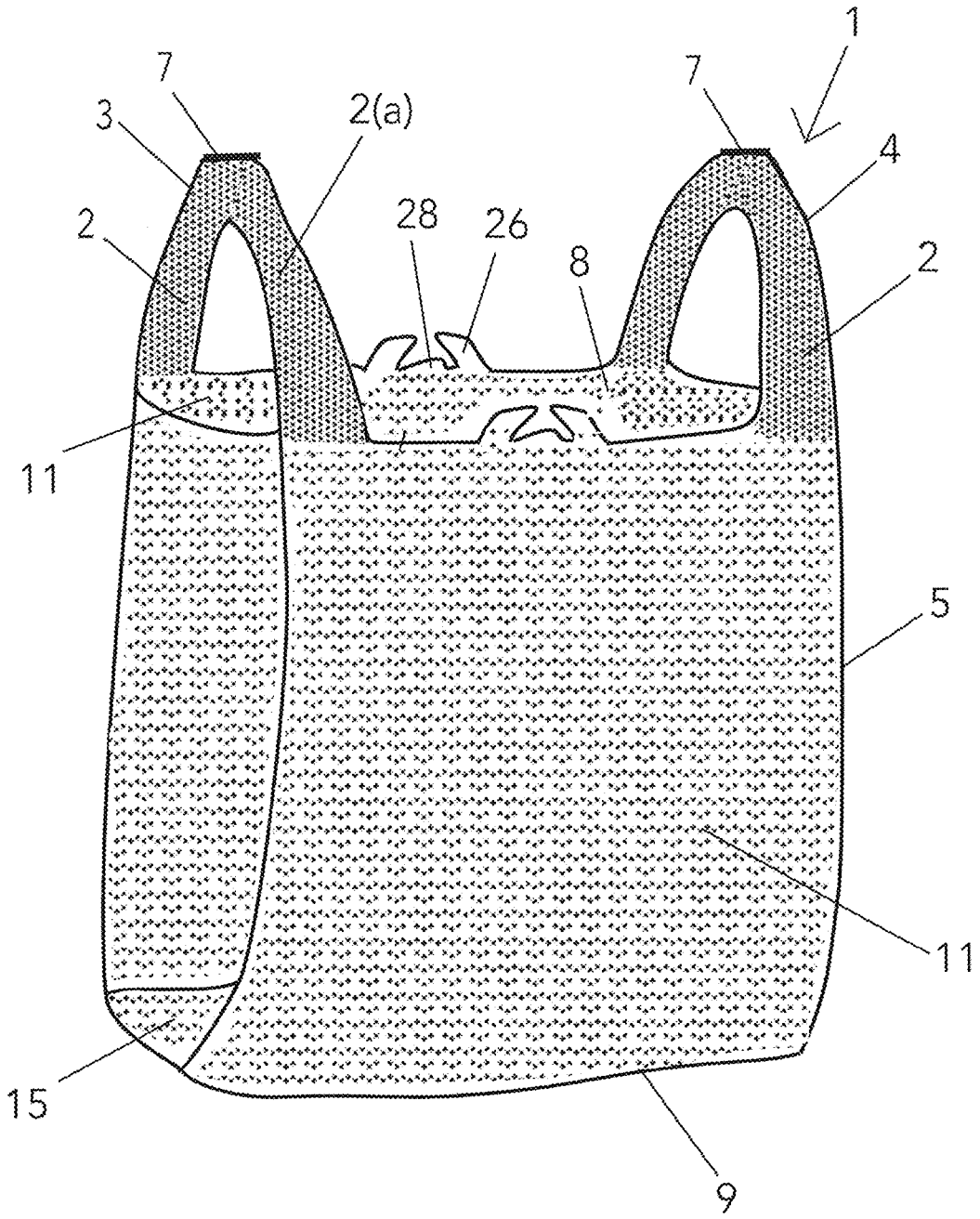
FIG. 3 is a perspective view of the plastic bag in the frontal view with a semi-transparent-colored main body in plastic film and color identifying handles. The main body of the bag is a different color than the handles.

FIG. 3 is a perspective view of the plastic bag 1 in the frontal view with a main body 5 with the main body 5 semi-transparent-colored 11, and showing the handles 3+4 characteristic 2 that is different than the main body 5 color or color scheme. The rear and sides of the plastic bag 1 main body 5 are also shown with the main body 5 semi-transparent-color 11. The characteristic 2 is shown in a color 2(*a*).

Figure 4:
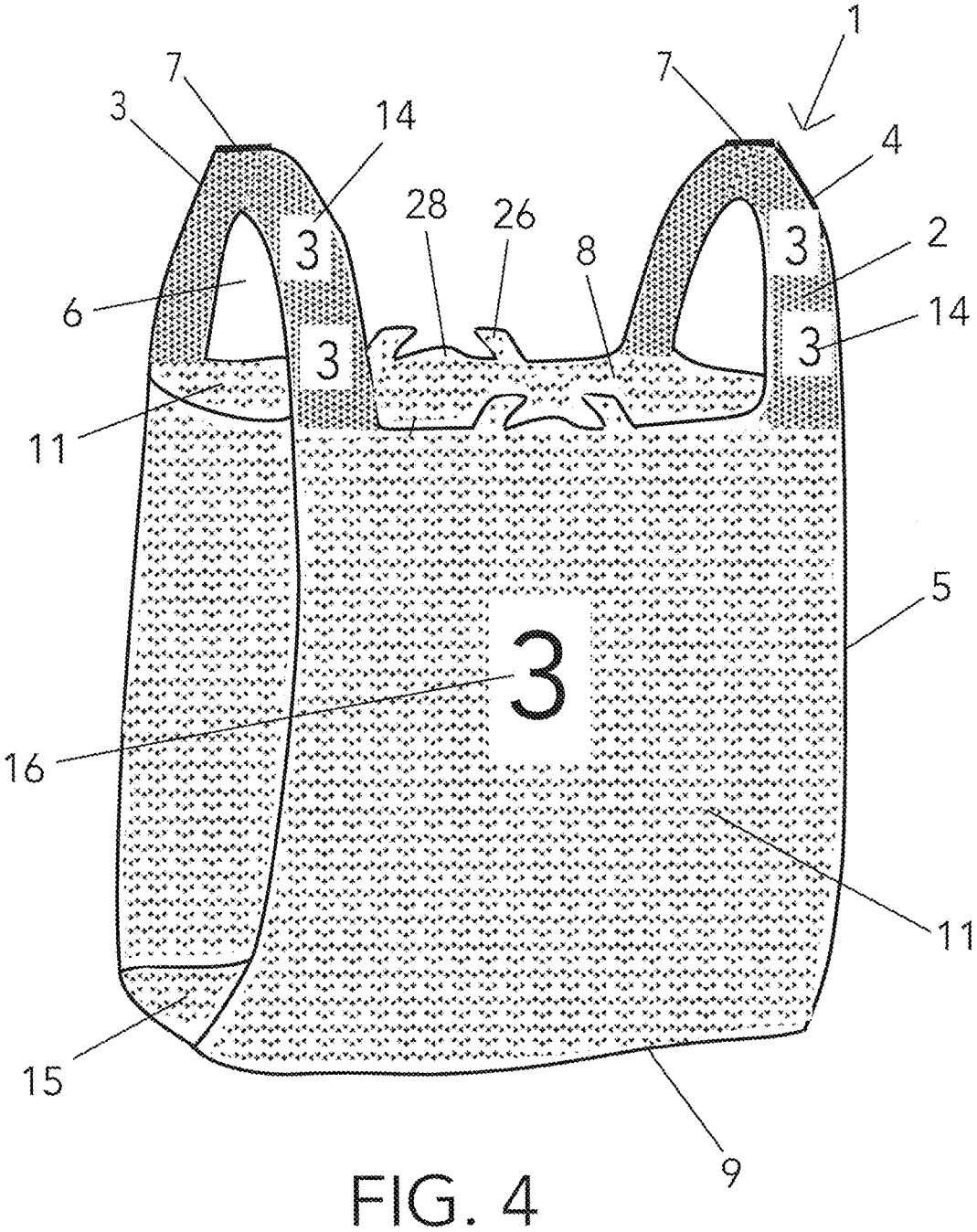
FIG. 4 is a perspective view of the plastic bag in the frontal view with a semi-transparent-colored main body in plastic film and colored identifying handles. The main body is a different color, tint of color, color scheme, or pattern than the handles, and the plastic bag having identifying numerals on the main body and the handles of the bag.

FIG. 4 is the same grocer bag of FIG. 3 with added identifying numerals added to the main body 5 and the handles 3+4, in a perspective frontal view showing the main body numeral 16 on the main body 5 of the bag 1, and showing the handle 3+4 numerals 2(*d*) in multiple locations on each handle 3+4. The main body numeral 16 of the bag 1 would generally be larger in size than the handle numeral 2(*d*). This plastic bag 1 displayed can be usable by a person wishing to identify the plastic bag 1 by a number or by a color-blind person with difficulty distinguishing different colors or color schemes.

Figure 5:
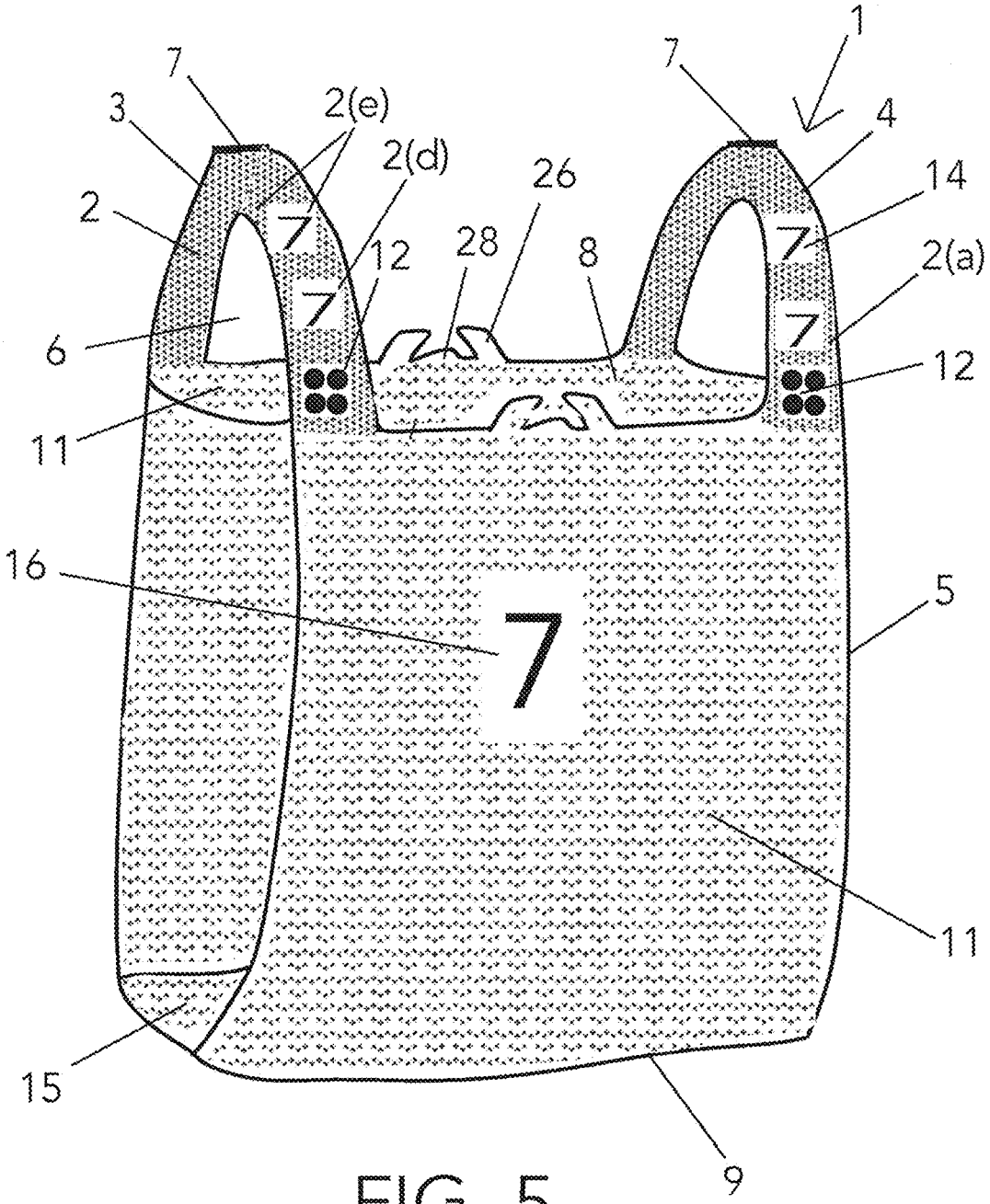
FIG. 5 is a perspective view of the plastic bag in the frontal view with a semi-transparent-colored main body in plastic film and colored identifying and Braille numbered handles with a numeral on the handles and on the main body of the bag. The plastic bag markings would generally be used with a visually impaired person such as a blind or color-blind person.

FIG. 5 is a perspective view of the plastic bag 1 with markings that would generally be used with a visually impaired person such as a blind or color-blind person, or the plastic bag 1 can be used by any person with or without a visual impairment. Shown is the frontal view with a Braille number 12 and multiple numerals 2(*d*) on both the front side of the handle 3 and the front side of the handle 4. Typically there will also be Braille numbers 12 and multiple handle numerals 2(*d*) on the rear side of the handle 3 and the rear side of the handle 4. To aid a visually impaired person using the plastic bag 1, Braille numbers 12 are typically located on or near the base of each handle 3+4 on both the front side of the bag 1 and on the rear side of the bag 1. The base of the first handle 3 and the second handle 4 for the location of the Braille number 12 and is an easy position to locate for the visually impaired person of the plastic bag 1. While the plastic bag 1 is held in the dispenser rack 18 (see FIG. 6) and a group of stacked bags 38 (see FIG. 8) are positioned in the dispenser rack 18 (see FIG. 6), the handles 3+4 can be found and felt with the person's hands. The handle numeral 2(*d*) shown on the plastic bag handles 3+4 can typically be displayed on the handles 3+4 in a different color than the handle 3+4 color, or in the alternative, the area around the handle numeral 2(*d*) can be devoid of color allowing for an easy identification of the handle numerals 2(*d*). In addition to the handle numerals 2(*d*), a main body numeral 16 can also be placed on the main body 5 of the plastic bag 1 on the front and the back of the bag 1, allowing for further easy identification of the plastic bag 1 by someone other than a blind person. In the instance that a multitude of fill bags 1 are located next to each other, the main body numeral 16 may not be visible.

One reason for both the handle numerals 2(*d*), main body numerals 16, and the Braille numbers 12 to be located on the plastic bag handles 3+4 would be that it is probable that when a visually impaired person is using the plastic bag 1, he or she may possibly be accompanied by a seeing guide person to assist the visually impaired person. The guide person can identify the Braille number 12 on the plastic bag 1 handles 3+4 by viewing the handle numeral 2(*d*) on the plastic bag handles 3+4 allowing easy communication between the guide person and the visually impaired person in discussing a particular plastic bag 1 number 2(*d*) and the plastic bag 1 contents. Also shown is the combination of the (handle numeral 2(*d*) and the color 2(*a*)) 2(*e*) of the handle 3.

In the instance there is a group of bags 38+40 and subgroups of bags 50+52 in a dispenser rack 18, each handle 3+4 characteristic 2 in each subgroup of bags 50+52 can be assigned a matching numeral 2(*d*) distinctive to the corresponding characteristic 2 and the numeral 2(*d*) is displayed in at least one location on each corresponding handle 3+4 of each pair of handles 3+4 of the subgroup of bags 50, and the numeral 2(*d*) can also be displayed in tactile Braille 12 in at least one of, i) each corresponding handle 3+4 of each pair of handles 3+4 of the subgroup of bags 50, ii) the main body 5 of the bag 1, the succession of numerals 2(*d*) in each subgroup of bags 50 succeeding in numerical order.

Figure 6:
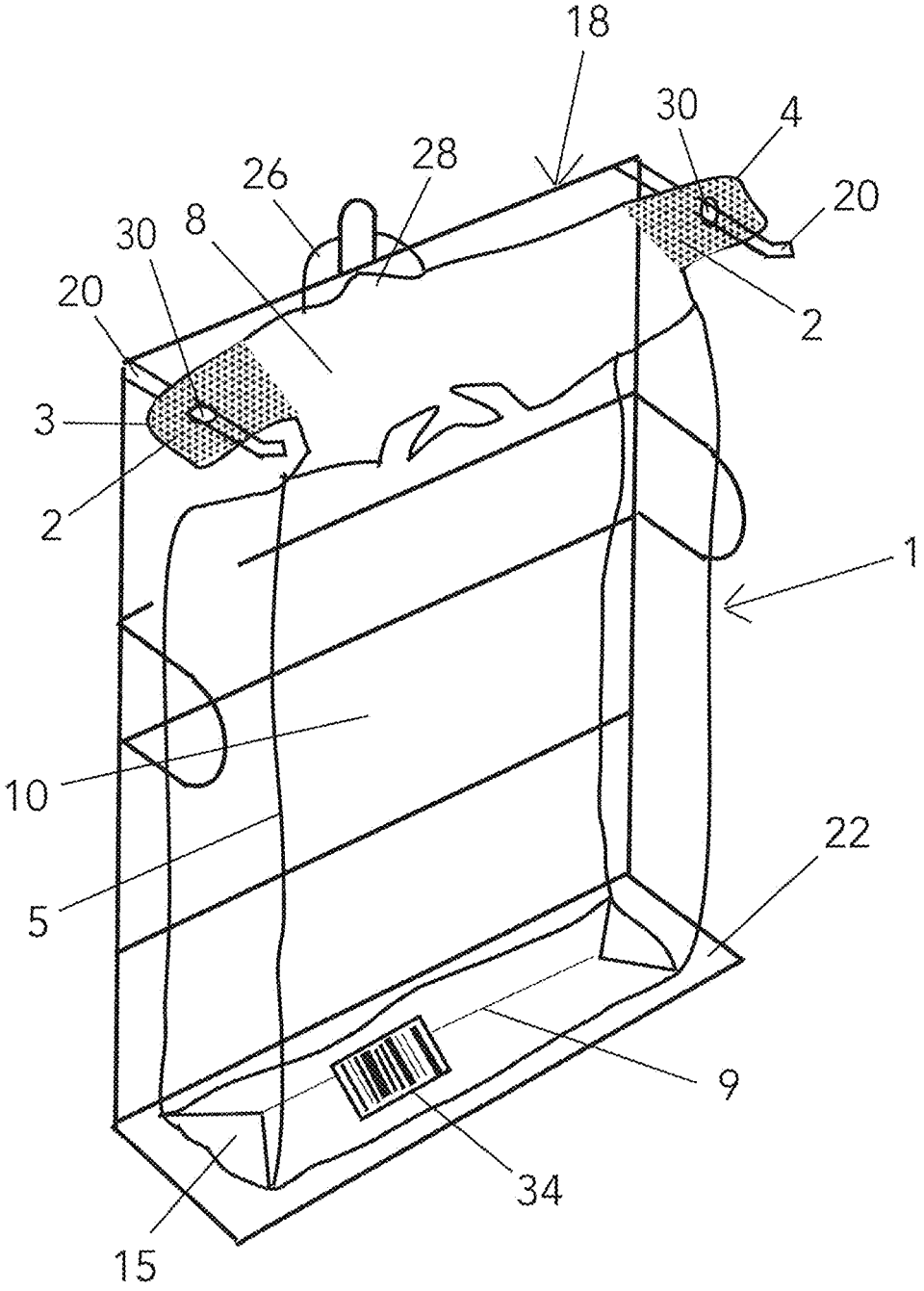
FIG. 6 is a perspective view of the bag in a dispenser rack, the bag comprising an optional Universal Product Code (UPC) on the bottom of the bag.

FIG. 6 is a perspective view of the dispenser rack 18 holding an open plastic bag 1 and where in the plastic bag 1 is hanging and held right side up by the handle hanger holes 30 and the main body hanger 26. Typically, in the dispenser rack 18, the group of stacked bags 38 (see FIG. 8) stands upright behind the open plastic bag 1 and all of the bags 1 hang in the dispenser rack 18 together. The group of stacked bags 38 (see FIG. 8) are bonded together with the bag pull tab 28 creating a system where when the outside bag is removed from the dispenser rack 18, the next bag in succession is opened at the mouth of the bag 8 and ready for the entry of products into the main body 5 of the bag 1. Shown hanging in the dispenser rack 18 is the plastic bag 1 hanging on the dispenser rack 18 supporting arms 20 and supported by the first handle 3 and the second handle 4. The main body 5 of the plastic bag 1 is semi-transparent-colorless 10 and the handles 3+4 characteristic 2 are shown being significantly visually distinguishable from the main body 5 of the plastic bag 1. The bottom seal 9 of the plastic bag 1 is upon the rack base 22 and mouth of the bag 8 is shown at the top of the plastic bag 1. On the bottom of the bag 1, a Universal Product Code (UPC) 34 is displayed. This bottom location of the UPC code 34 may be beneficial to the end user for scanning the UPC code 34 by simply placing the plastic bag 1 on a scanner, and the code is scannable for identification of the products inside the bag 1, assuming all of the products inside the bag 1 are the same product. The bottom location of the Universal Product Code (UPC) can cross the bottom seal 9 on the bottom of the bag 1 and be displayed on both sides of the bottom seal 9. Shown at the bottom of the bag 1 is a gusset 15 that partially forms a flat bottom of the bag 1.

Figure 7:
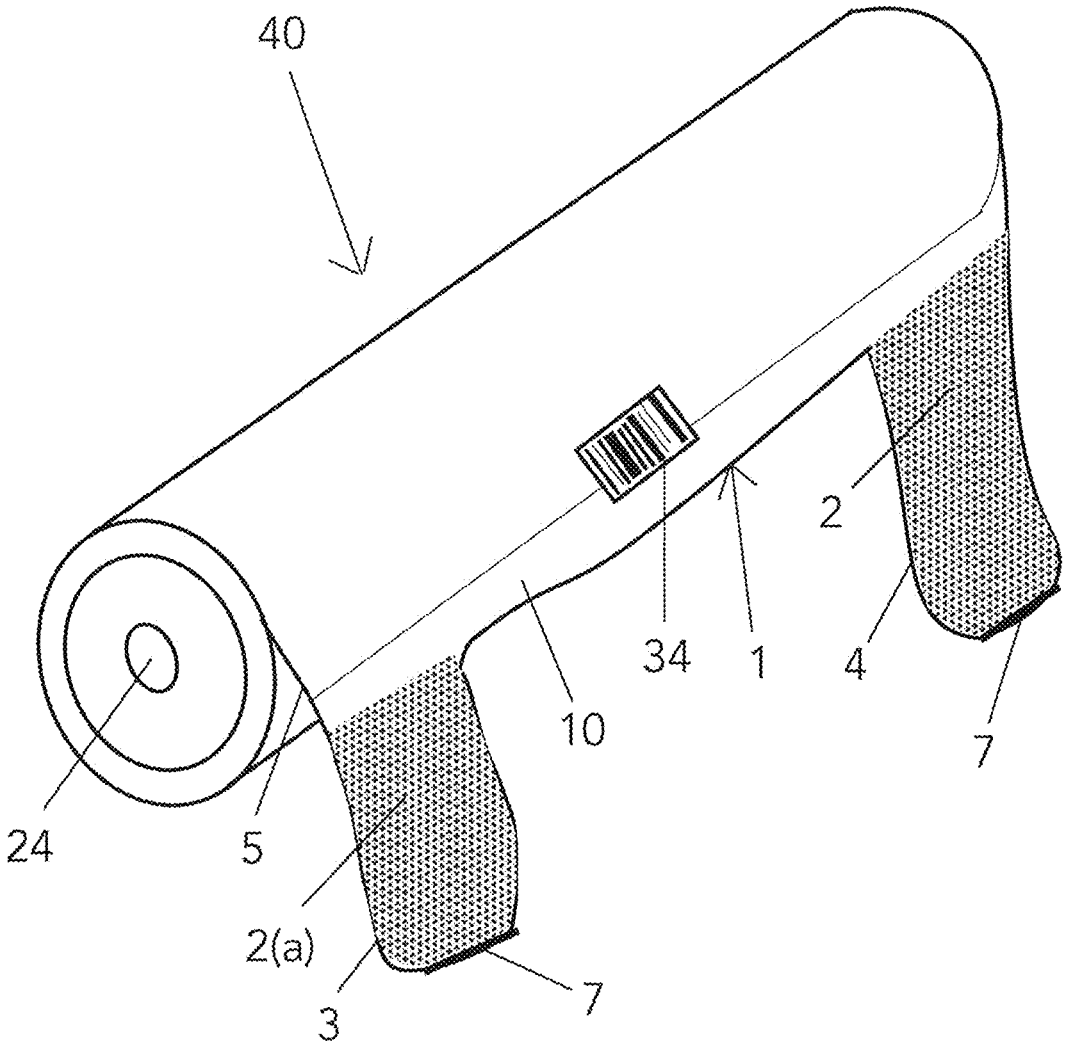
FIG. 7 is a perspective view of a group of rolled bags attached to a dispenser rack, the bag comprising an optional Universal Product Code (UPC) on the main body of the bag.

FIG. 7 is a perspective view of the group of rolled bags 40. The group of rolled bags 40 comprising multiples of bags 1 comprising the handle 3+4 characteristic 2 of a color 2(*a*). The bags 1 are flattened, arranged and aligned in a group, the group prepared for use in a dispenser such as a dispenser rack 18. The group of rolled bags 40 turns on a pivot hole 24, and the group of rolled bags 40 arranged for the removal of the bags in succession from the dispenser rack 18. This aligned group is a group of rolled bags 40. The group of rolled bags 40 are aligned in series wherein the bottom of one bag is attached to or lying close to the top of the next bag.

The main body 5 of the plastic bag 1 is shown wrapped around the dispenser rack 18. Handles 3+4 are shown with the characteristic 2. Removing the plastic bag 1 from the dispenser rack 18 is accomplished by pulling on the plastic bag 1 to turn the dispenser rack 18. Various rolls of group of rolled bags 40 are used in the marketplace on the dispenser rack 18. One type of group of rolled bags 40 requires each plastic bag 1 to be torn from the next successive plastic bag 1, in this group the plastic bags 1 are sealed or joined together on a perforation between each plastic bag 1. Another type of group of rolled bags 40 mounted on a dispenser rack 18 allows each plastic bag 1 to simply fall off of the group of rolled bags 40 when the dispenser rack 18 is turned far enough to release the bag 1 from the group of rolled bags 40 and the dispenser rack 18. The plastic bags 1 are shown with the main body 5 of the bags in semi-transparent-colorless 10. Shown on the end of the handles 3+4 are the handle folds and overlaps 7 that help strengthen the handles by doubling the plastic film of the handles 3+4.

Figure 8:
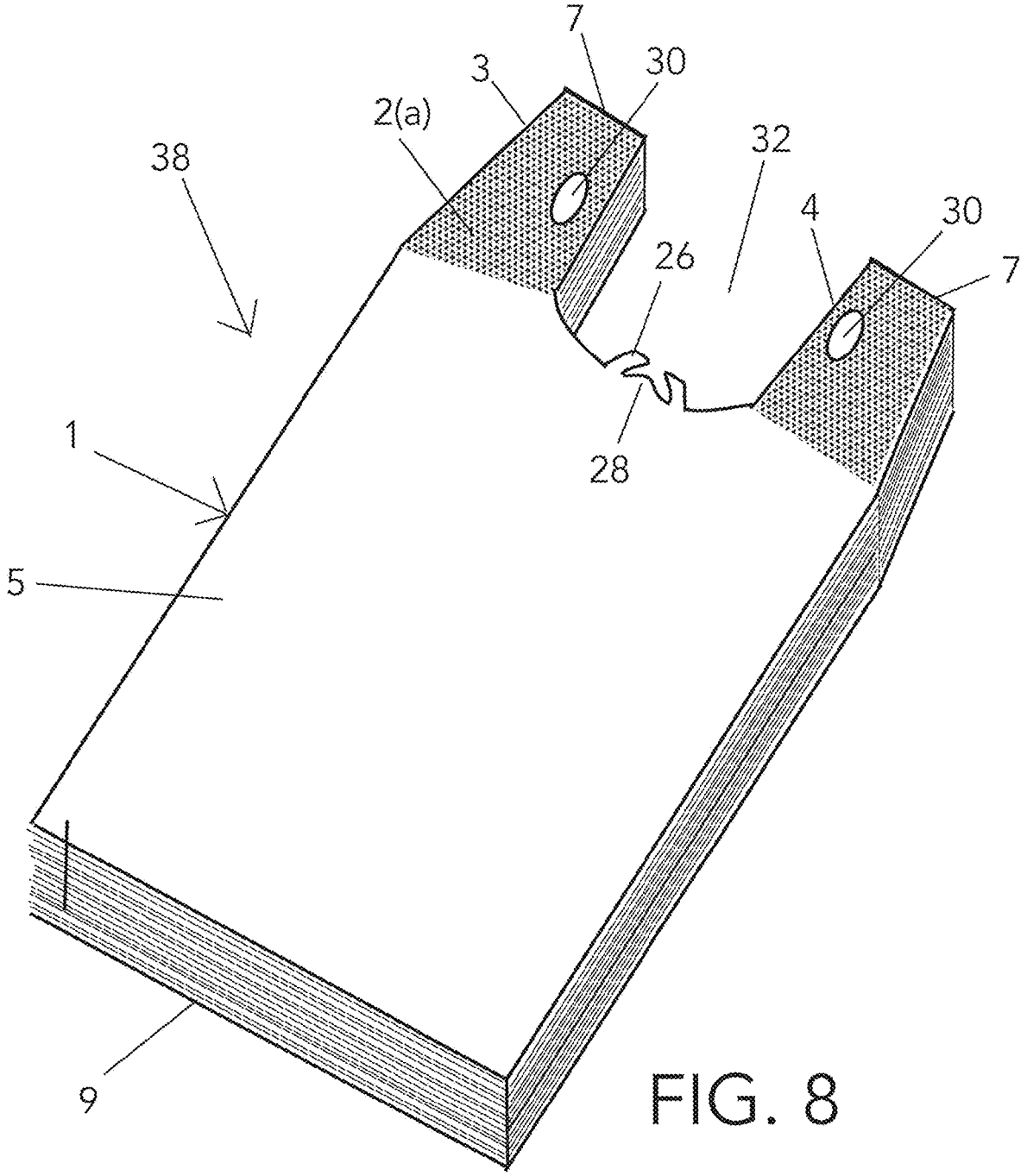
FIG. 8 is a perspective view of a group of stacked bags.

FIG. 8 is a perspective view of the group of stacked bags 38 not yet placed into a dispenser rack 18 (see FIG. 6). The group of stacked bags 38 comprises multiples of bags 1 comprising the handle 3+4 characteristic 2 of a color 2(*a*). The bags 1 are flattened, arranged and aligned in the group of stacked bags 38, and prepared for use in the dispenser such as the dispenser rack 18, and the group arranged for the removal of the bags 1 in succession from the dispenser rack 18. This group of bags is a group of stacked bags 38. Also shown is the mouth cutout 32, although the handle cutouts 6 (see FIG. 9) are not shown in this drawing. The handle cutouts 6 (see FIG. 9) are covered over when the handle folds and overlaps 7 are made, therefore reducing the width of the handles 3+4 but at the same time increasing the strength of the handles 3+4 by doubling the plastic film coverage of the handles 3+4. The bottom seal 9 of the bag is shown at the bottom of the bag and the main body hanger 26 and the bag pull-tab 28 are shown. The handle hanger holes 30 are shown near the top of the bag allowing the group of stacked bags 38 to hang in the dispenser rack 18 (see FIG. 6). Although in FIG. 8 the handles 3+4 appear to have only one handle hanger hole 30 in each handle 3+4, when the handles 3+4 are unfolded from the flattened arrangement, two handle hanger holes 30 are visible in each handle 3+4 (see FIG. 2*d*). The group of stacked bags 38 wherein each handle 3+4 in the group of stacked bags 38 comprises two handle hanger holes 30 for hanging the handles 3+4 on the dispenser rack 18, therefore, the handles 3+4 supporting the group of stacked bags 38 in an upright position in the dispenser rack 18. The main bodies 5 of the bags 1 are stacked one on top of the other arranging the alignment into a group of stacked bags 38. The group of stacked bags 38 is aligned in parallel wherein the bottoms of all of the bags in the group are aligned with each other and the tops of all of the bags in the group are aligned with each other.

A preferred system of dispensing the bags 1 from the dispenser 18 also provided herein to be applied and used in practice. The system wherein a group of stacked bags 38 comprising the characteristic 2 of the handles 3+4 of the bag 1 which is first in line for removal in succession from the dispenser differs from and is significantly visually distinguishable from the characteristic 2 of the handles 3+4 of the bag 1 next in line for removal in succession from the dispenser rack 18. The system of a group of stacked bags 38 can also comprise successive subgroups of stacked bags 50 within the group of stacked bags 38, wherein each subgroup of stacked bags 50 can be removed from the dispenser rack 18 in succession and each bag 1 within each subgroup of stacked bags 50 can be removed from the dispenser rack 18 in succession, and wherein the characteristic of each pair of the handles 3+4 of each bag within each subgroup of stacked bags 50 differs from and is significantly visually distinguishable from the characteristic of every other pair of the handles 3+4 of the bags in the same subgroup of stacked bags 50. In addition, and optionally, the handle 3+4 characteristic 2 succession order and each handle 3+4 characteristic 2 in each subgroup of stacked bags 50 is matching and consistent with the other subgroups of bags 50 within the group of stacked bags 38. The described system of a group of stacked bags 38 in this herein paragraph can also be applied to a system comprising the group of rolled bags 40.

Figure 9:
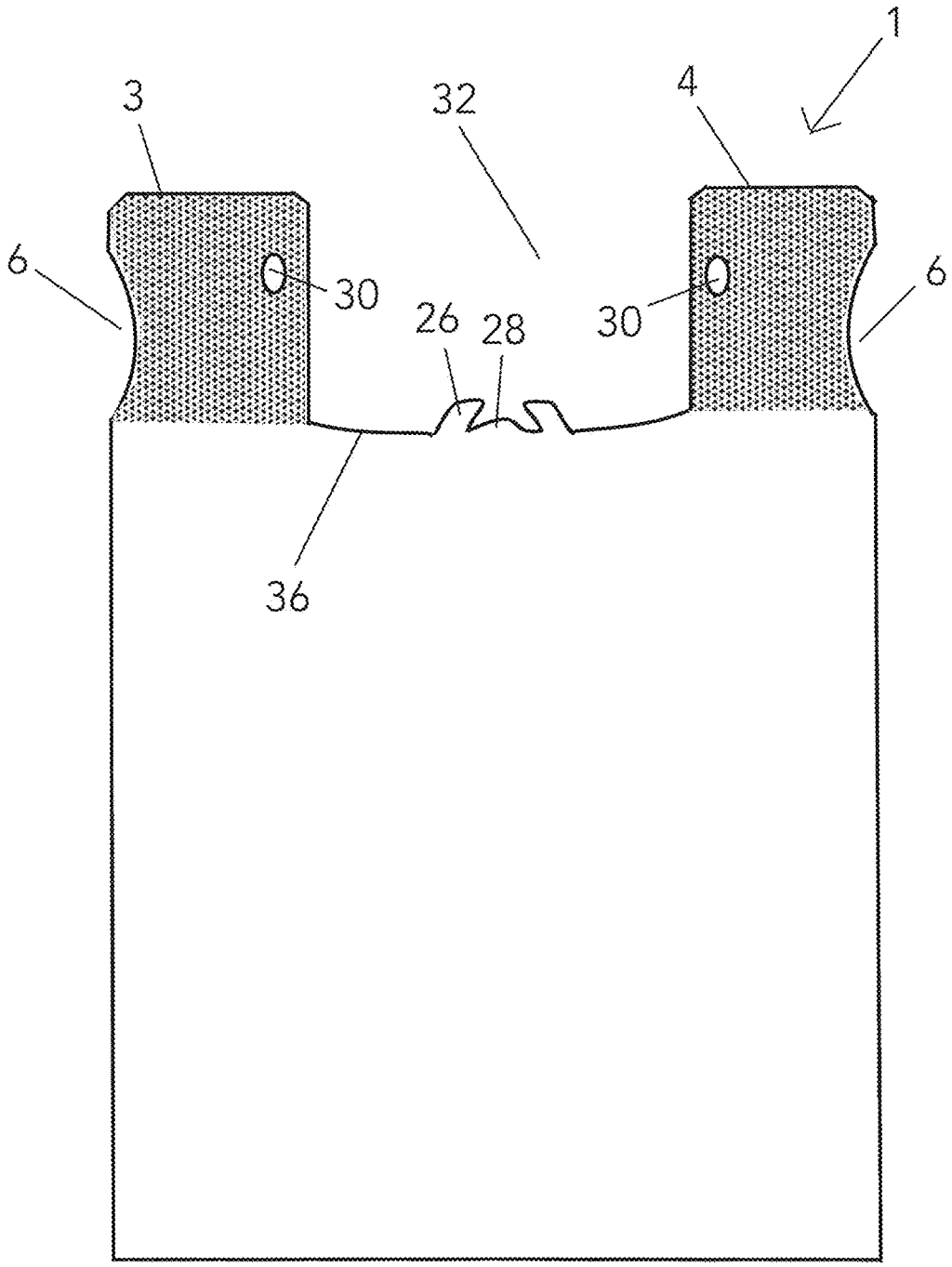
FIG. 9 is a top view of a flattened and collapsed bag after portions of the bag has been cut out and before the handles are folded and sealed into position.

FIG. 9 is a top view of a flattened and collapsed bag 1 showing after cutting out portions of the bag to form the handles 3+4 and the mouth of the bag 8. The handle aperture 6 portions are cutout of the side edges of the bag 1 and the mouth cutout 32 is cut out of the top of the bag 1. Prior to arranging the bags 1 into the group of stacked bags 38 (see FIG. 8), the handles 3+4 are folded creating the handle fold and overlap 7 (see FIG. 2*a*) at the top of the handles 3+4. FIG. 9 as shown displays the bag 1 before the handles 3+4 are folded prior to arranging the bags into a group of stacked bags 38. The handle hanger holes 30 are shown as one hole in each handle while the bag 1 is in a flattened disposition, the handle hanger holes 30 expand into two holes when the handles 3+4 are unfolded when the bag is opened and formed into a tubular structure. The main body hanger 26 and the bag pull-tab 28 are shown attached to the mouth rim 36.

Figure 10:
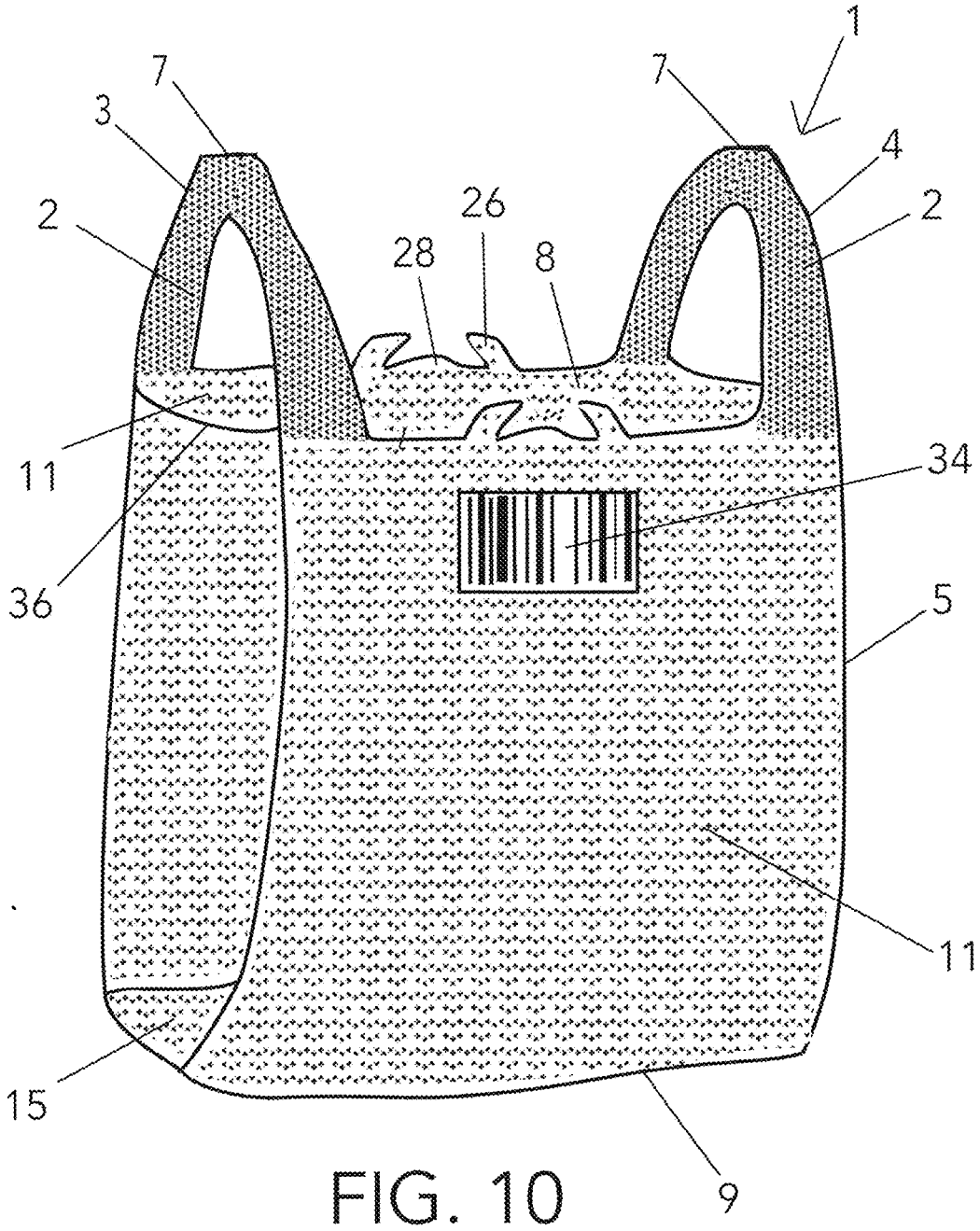
FIG. 10 is a perspective view of the bag with a Universal Product Code displayed on the main body of the bag.

FIG. 10 is a perspective view of the bag with a Universal Product Code (UPC) 34 displayed just underneath the mouth rim 36 on the main body 5 of the bag 1.

Figure 11:
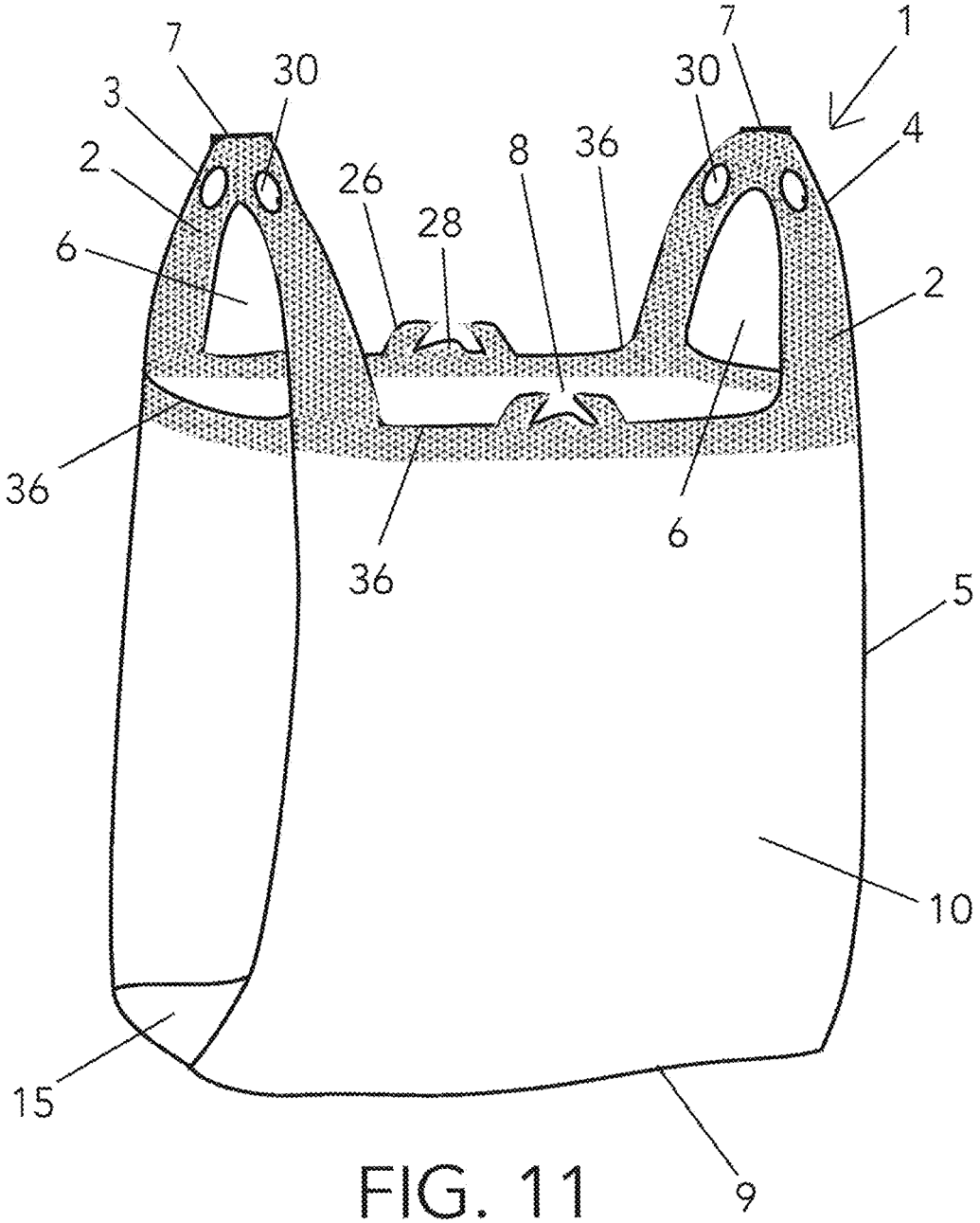
FIG. 11 is a perspective view of the bag showing the handle color extending into the main body of the bag, therefore highlighting the rim of the mouth opening.

FIG. 11 is a perspective view of the bag 1 showing the handles 3+4 characteristic 2 extending into the main body 5 of the bag 1, therefore highlighting the rim 36 of the mouth of the bag 8. The handles 3+4 characteristic 2 extends around all sides of the bag 1 and covering about one inch in height just below the mouth rim 36. The main body hangers 26 and the bag pull-tab 28 are also shown to be identified with the handles 3+4 characteristic 2. The handles 3+4 characteristic 2 extending into the main body 5 of the bag 1 may assist the end user of the bag 1 in finding and opening the mouth 8 of the bag 1. The characteristic 2 of the mouth rim 36 being the same characteristic 2 as the handles 3+4 may also make the bag 1 easier to differentiate from other bags in the immediate location or in a bunch of open bags 37 (see FIG. 2*a*).

The characteristic of the handles may optionally extend from the top of the handles 3+4 down to at least the mouth of the bag 8, the characteristic of each handle 3+4 encircles the handle aperture 6, and the characteristic is visually evident from all sides of the bag 1 when the handles 3+4 are in sight. In addition, the handle 3+4 characteristic 2 also can also extend down into the main body 5 and past the mouth rim 36, therefore, significantly visually identifying the mouth rim 36 of the bag 1. The handles 3+4 characteristic 2 extension down into the main body 5 of the bag 1 can be about 2.5 cm or about one inch.

Figure 12:
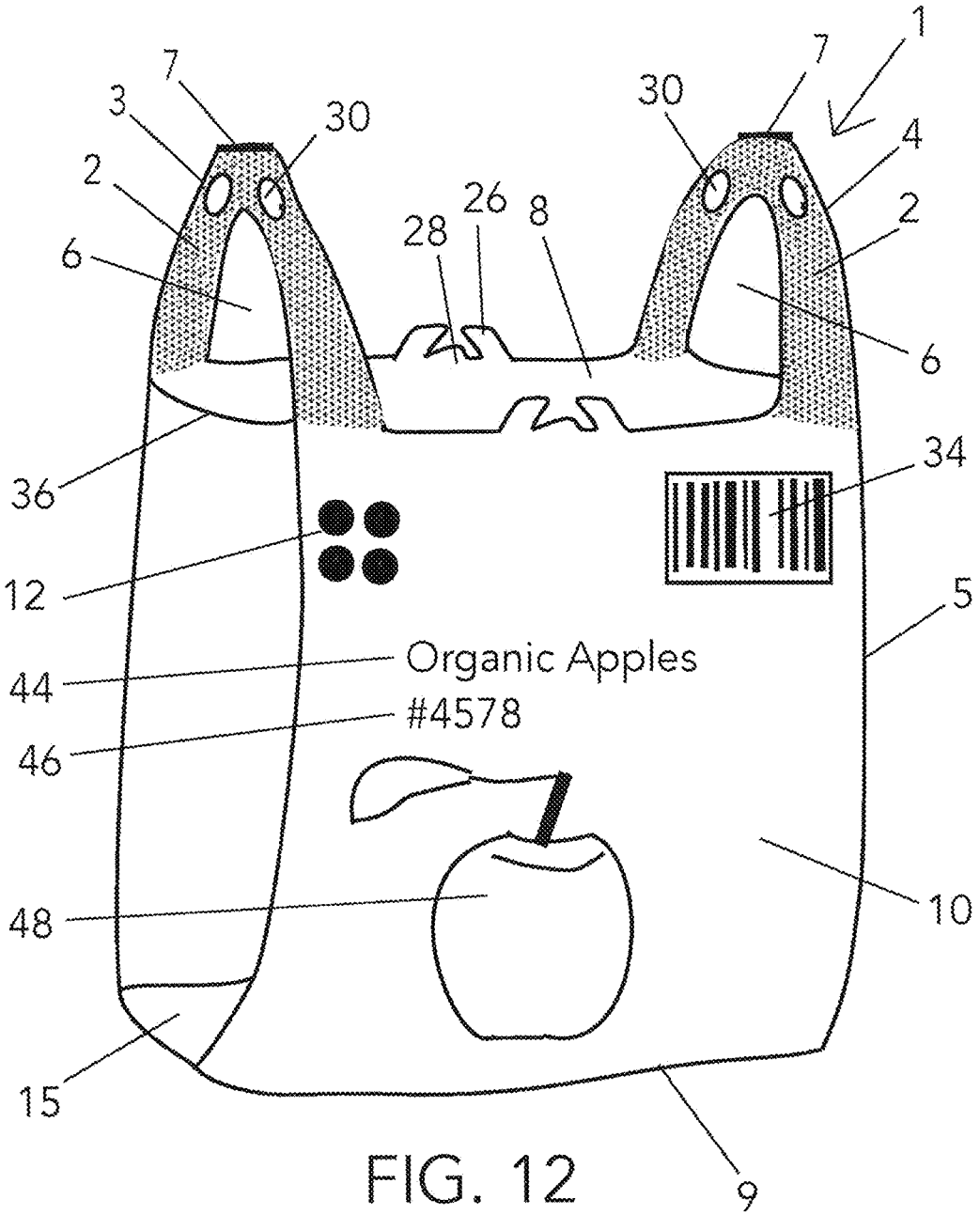
FIG. 12 is a perspective view of the bag similar to FIG. 2*c* with additional characteristics added.

FIG. 12 is a perspective view of the bag 1 similar to FIG. 2*c*. Added to the bag 1 are identifiable attributes that can be displayed in at least one location on the bag 1, the product name 44, a product picture, and the tactile Braille number 12. In addition, a product identification code can be displayed on the bag, the product identification code can be company or corporation distinguished or a Universal Product Code (UPC) capable of being scanned and identified by a scanner, or any other type of product identification code. One or all of these mentioned attributes could be displayed on the plastic bag 1 in at least one location.

Figure 13:
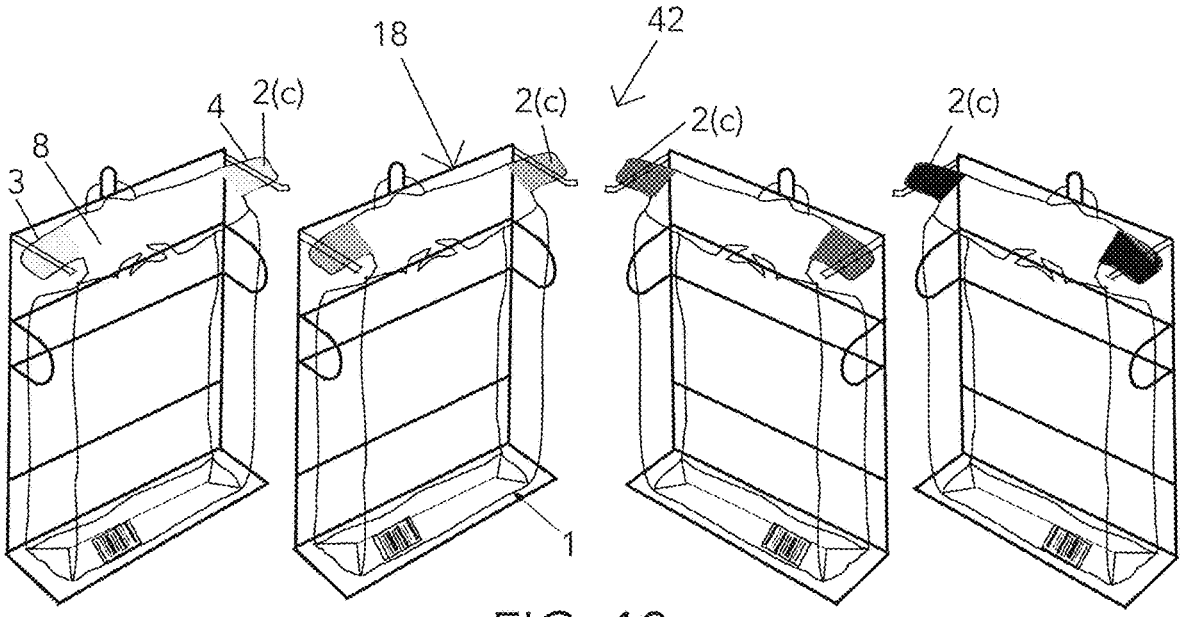
FIG. 13 is a perspective view of a cluster of stacked bags, each bag residing in a separate dispenser rack.

FIG. 13 is a perspective view of a system for bagging products in separate dispenser racks 18, each dispenser rack 18 holding a group of stacked bags 38. The system comprises a cluster of stacked bags 42 comprising multiple groups of stacked bags 42, and wherein each group of stacked bags 42 resides in and is supported by a separate dispenser rack 18, and wherein the current next in succession bag 1 to be dispensed from each dispenser rack 18 is in an open position. Each group of stacked bags 38 resides close in proximity to at least one other group of stacked bags 38 in the cluster of stacked bags 42. Each bag 1 in the group of stacked bags 38 is positioned for use and dispensing from the dispenser rack 18 in succession after the current next in succession bag 1 in the dispenser rack 18 is removed from the dispenser rack 18. The handles 3+4 of each bag 1 in each group of stacked bags 38 comprises a distinguishing characteristic 2 on all of or a portion of the handles 3+4 that is significantly distinguishable from the characteristic 2 of the handles 3+4 of each bag 1 in the other separate groups of stacked bags 38. In another scenario of the distinguishing characteristic 2 of the handles 3+4 of each bag 1, the handles 3+4 of each bag 1 in each dispenser rack 18 comprising a characteristic 2 on all of or a portion of the handles 3+4 resulting in the handles 3+4 visibly contrasting with the bags 1 visual surface appearance of the main body 5 of the bag 1 and visually contrasting with the visual surface appearance of the handles 3+4 of each bag 1 in the other separate groups of stacked bags 38 in the cluster of stacked bags 42. The characteristic 2 of different tints of a color 2(*c*), thereby making each bags 1 pair of handles 3+4 in each group of stacked bags 38 significantly visually distinguishable from the handles 3+4 of the bags 1 in each of the other groups of stacked bags 38. In addition and optionally, each group of stacked bags 38 in each dispenser rack 18 has the same handle characteristic 2 of the corresponding opened bag 1 in the same dispenser rack 18. Further in addition and optionally, wherein each dispenser rack 18 comprises the group of stacked bags 38 that comprises subgroups of stacked bags 50, each complete subgroup of stacked bags 50 in each dispenser rack 18 has at least one bag 1 with the same handle characteristic 2 of the corresponding open bag 1 residing in the same dispenser rack 18.

The cluster of stacked bags 42 is common to see in grocery markets at self serve stands where the customer scans and places the grocery products in opened bags 1 of the cluster of stacked bags 42. In the disclosed invention, having the handles 3+4 of each opened bag 1 of the cluster of stacked bags 42 of the different handle 3+4 characteristic 2 than the other bags 1 in the cluster of stacked bags 42 will allow the customer to pick the handles 3+4 with the characteristic 2 of the bag 1 he or she wants. The different characteristics 2 of matching pairs of handles 3+4 of different bags 1 of the cluster of stacked bags 42 will assist the customer in grabbing a single pair of handles 3+4 at a time to lift one or more bags 1 at a time, the matching pair of handles 3+4 on a particular bag assists the customer in preventing the grabbing of two handles 3+3 that each belong to different bags 1+1.

Figure 14:
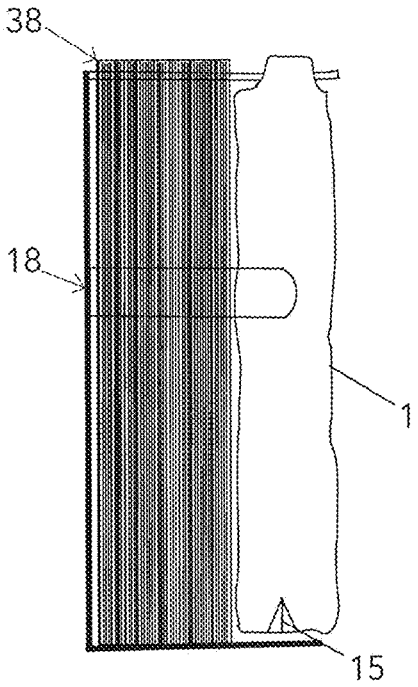
FIG. 14 is a side view of a dispenser rack comprising a group of stacked bags and a single bag that is open at the mouth of the bag.

FIG. 14 is a side view of a dispenser rack 18 comprising a group of stacked bags 38 and a single bag 1 that is open at the mouth 8 of the bag 1. The bag 1 that is opened at the mouth 8 is not considered a part of the group of stacked bags 38, although the group of stacked bags 38 and the bag 1 opened at the mouth 8 is both be part of the cluster of stacked bags 42. The gusset 15 of the open bag 1 is shown at the bottom of the bag 1. Each handle 3+4 in the group of stacked bags 38 comprising two handle hanger holes 30 for hanging the handles 3+4 on the dispenser rack 18 (see FIG. 13), therefore, the handles 3+4 supporting the group of stacked bags 38 in an upright position in the dispenser rack 18.

Figure 15:
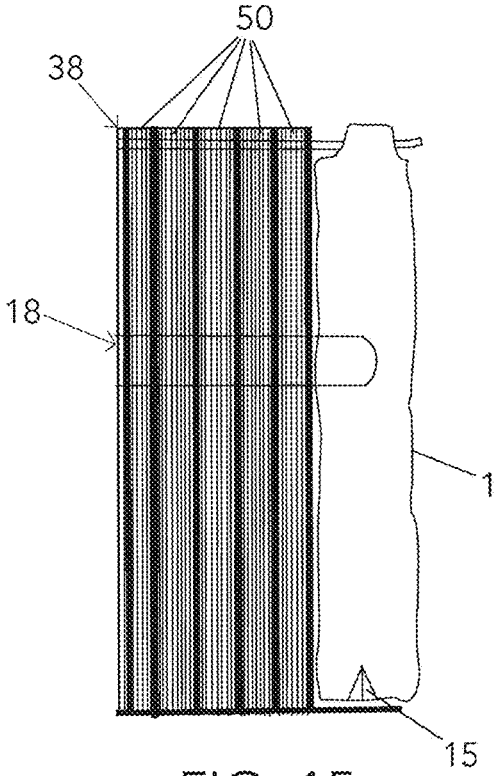
FIG. 15 shows the group of stacked bags in the dispenser rack comprising successive subgroups of stacked bags, and a single bag that is open at the mouth of the bag.

FIG. 15 shows the group of stacked bags 38 in the dispenser rack 18 that comprises successive subgroups of stacked bags 50, wherein each bag 1 within each subgroup of stacked bags 50 can be removed from the dispenser rack 18 in succession, and wherein the characteristic 2 of each pair of handles 3+4 within each subgroup of stacked bags 50 differs from every other characteristic 2 of the other pairs of the handles 3+4 in the same subgroup of stacked bags 50. In an alternative in refining the subgroups of stacked bags 50, each pair of the handles 3+4 within each subgroup of stacked bags 50 comprises the characteristic 2 that matches in color but differs in tint from every other characteristic 2 of the other pairs of the handles 3+4 in the same subgroup of stacked bags 50. In another alternative in refining the group of stacked bags 38, each handle characteristic 2 succession order and each handle characteristic 2 in each subgroup of stacked bags 50 is matching and consistent to the other subgroups of stacked bags 50 of the group of stacked bags 38, the bags are readied for dispensing and opening after the corresponding open bag 1 in the group of stacked bags 38 that is residing in the dispenser is removed from the dispenser rack 18, and each subgroup of stacked bags 50 in each dispenser rack 18 has at least one bag 1 with the same handle 3+4 characteristic 2 of the corresponding open bag 1 in the group of stacked bags 38 residing in the same dispenser.

Figure 16:
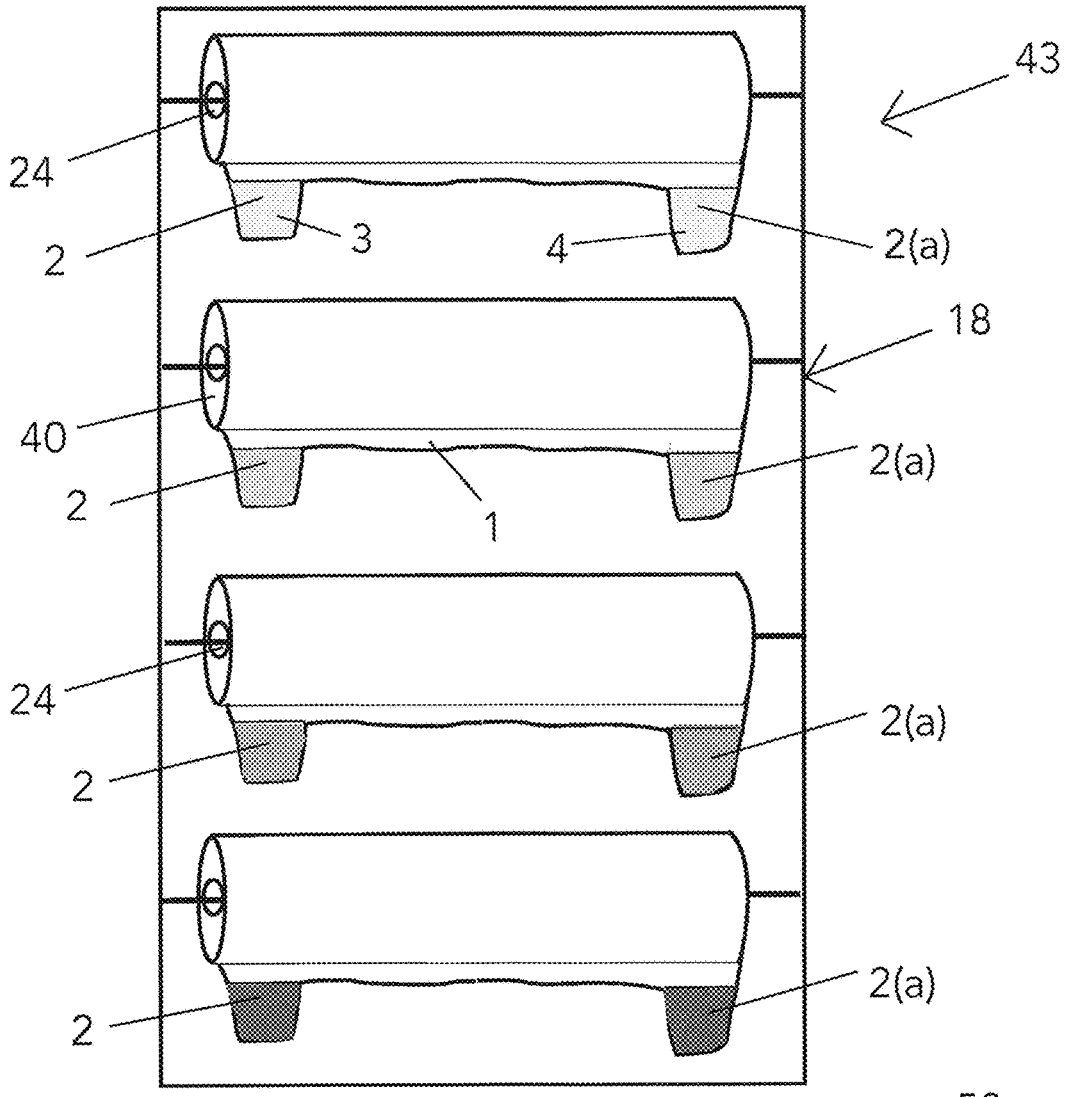
FIG. 16 is a perspective view of a system for bagging products from a dispenser rack; the system comprises a cluster of rolled bags supported in a dispenser rack.

FIG. 16 is a perspective view of a system for bagging products from a dispenser rack 18 with groups of rolled bags 40, the system comprises a cluster of rolled bags 43 residing in a dispenser rack 18, the cluster of rolled bags 43 comprises multiple groups of rolled bags 40. Each group of rolled bags 40 resides close in proximity to at least one other group of rolled bags 40 in the cluster of rolled bags 43. Each group of rolled bags 40 is residing in the same dispenser rack 18. The handles of each bag 1 in each group of rolled bags 40 comprises a distinguishing characteristic 2 on all of or a portion of the handles 3+4 that is significantly distinguishable from the characteristic 2 of the handles 3+4 of each bag 1 in the other separate groups of rolled bags 40. In another scenario of the distinguishing characteristic of the handles 3+4 of each bag 1, the handles 3+4 of each bag 1 in each group of rolled bags 40 comprises a distinguishing characteristic 2 on all of or a portion of the handles 3+4 that visibly contrasts with the visual surface appearance of each corresponding bags 1 main body 5 and visibly contrasts with the visual surface appearance of the other bag 1 handles 3+4 of the other separate groups of rolled bags 40 in the cluster of rolled bags 43, the characteristic 2 of a color 2(*a*), thereby, making each bags 1 pair of handles 3+4 in each group of rolled bags 40 are significantly visually distinguishable from every other pair of handles 3+4 in the other groups of rolled bags 40 in the cluster of rolled bags 43. Each group of rolled bags 40 in the cluster of rolled bags 43 is readied for dispensing from the dispenser rack 18. In addition and optionally, each group of rolled bags 40 in the dispenser rack 18 comprises handles 3+4 that comprise the same characteristic 2 as all of the other handles 3+4 in the same group of rolled bags 40 while also being significantly visually distinguishable from the other bag 1 handles 3+4 of the other groups of rolled bags 40 in the cluster of rolled bags 43. Further in addition and optionally, wherein each dispenser rack 18 comprises the group of rolled bags 40 that comprises subgroups of rolled bags 52 and the subgroups of rolled bags 52 are readied for dispensing and opening after the corresponding next bag 1 in succession to be removed from the group of rolled bags 40, each complete subgroup of rolled bags 52 in the dispenser rack 18 has at least one bag 1 with the same handle 3+4 characteristic 2 of the corresponding successive next bag 1 to be removed from the same group of rolled bags. The bags 1 being close in proximity to at least one other bag 1 in the cluster of rolled bags 43 will generally mean that one bag in the cluster of rolled bags 43 is reachable by the end user when the end user is within reaching distance from another bag 1 in the cluster of rolled bags 43. The roll pivot hole 24 of the group of rolled bags 40 is shown.

Figure 17:
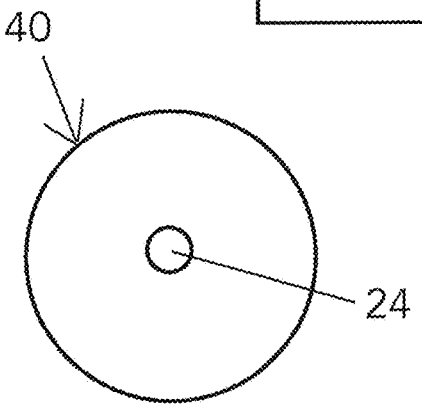
FIG. 17 is a side view of a group of rolled bags.

FIG. 17 is a side view of a group of rolled bags 40. The roll pivot hole 24 is shown.

Figure 18:
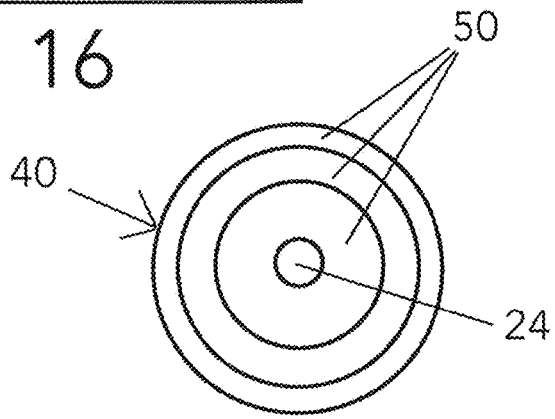
FIG. 18 is a side view of a group of rolled bags with subgroups of rolled bags.

FIG. 18 is a side view of a group of rolled bags 40 with subgroups of rolled bags 52. The subgroups of rolled bags 52 are shown with the different thicknesses of the rolled bags 40 overall thickness. The outer subgroup of rolled bags 52 has a larger diameter of the roll than the inner subgroups of rolled bags 52, therefore all of the subgroups of rolled bags 52 contain the same or close to the same number of individual bags 1. In an addition scenario, the characteristic 2 of each pair of handles 3+4 within each subgroup of rolled bags 52 differs from every other characteristic 2 of the other pairs of the handles 3+4 in the same subgroup of rolled bags 52. In an alternative in refining the subgroups of rolled bags 52, each pair of the handles 3+4 within each subgroup of rolled bags 52 comprises the characteristic 2 that matches in color but differs in tint from every other characteristic 2 of the other pairs of the handles 3+4 in the same subgroup of rolled bags 52. Each handle 3+4 characteristic 2 succession order and each handle 3+4 characteristic 2 in each subgroup of rolled bags 52 can be matching and consistent to the other subgroups of rolled bags 52 in the group of rolled bags 40.

Figure 19:
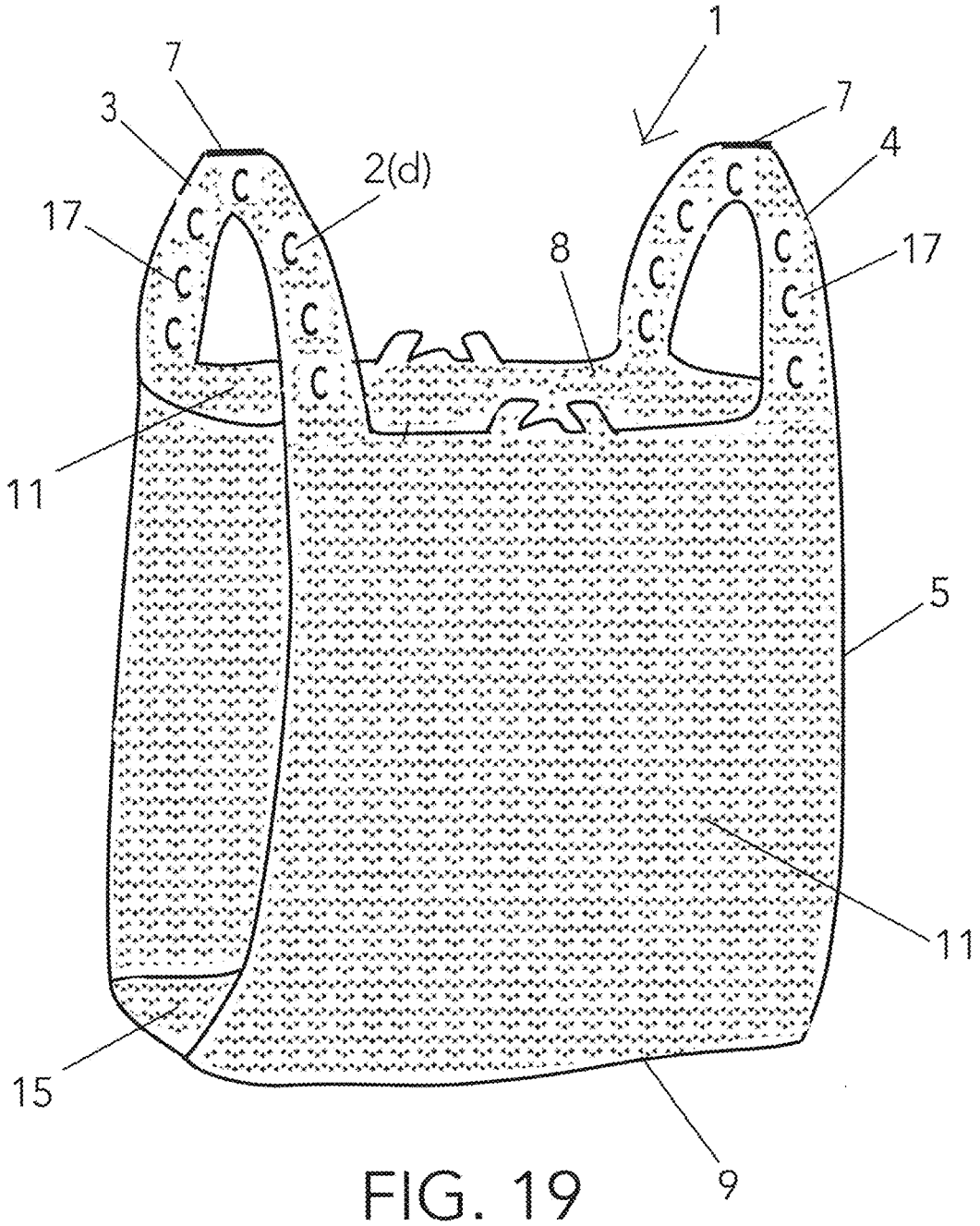
FIG. 19 shows letter characteristics on the handles.

FIG. 19 shows the characteristic 2 of a numeral 2(*d*) on the handles 3+4 making the handles 3+4 significantly visually distinguishable from the main body 5.

Figure 20:
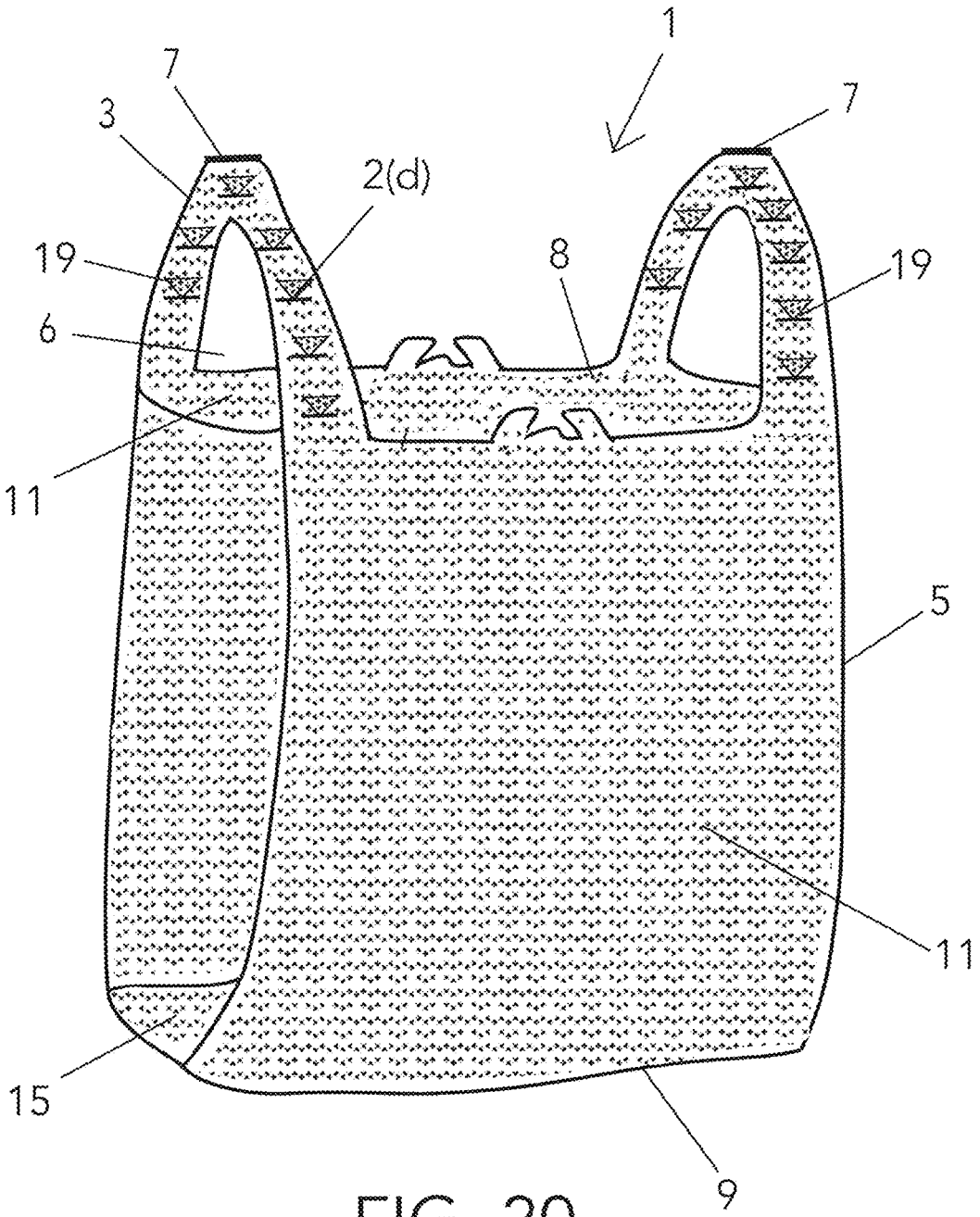
FIG. 20 shows insignia characteristics on the handles.

FIG. 20 shows the characteristic 2 of an insignia 2(*d*) on the handles 3+4 making the handles 3+4 significantly visually distinguishable from the main body 5.

Figure 21:
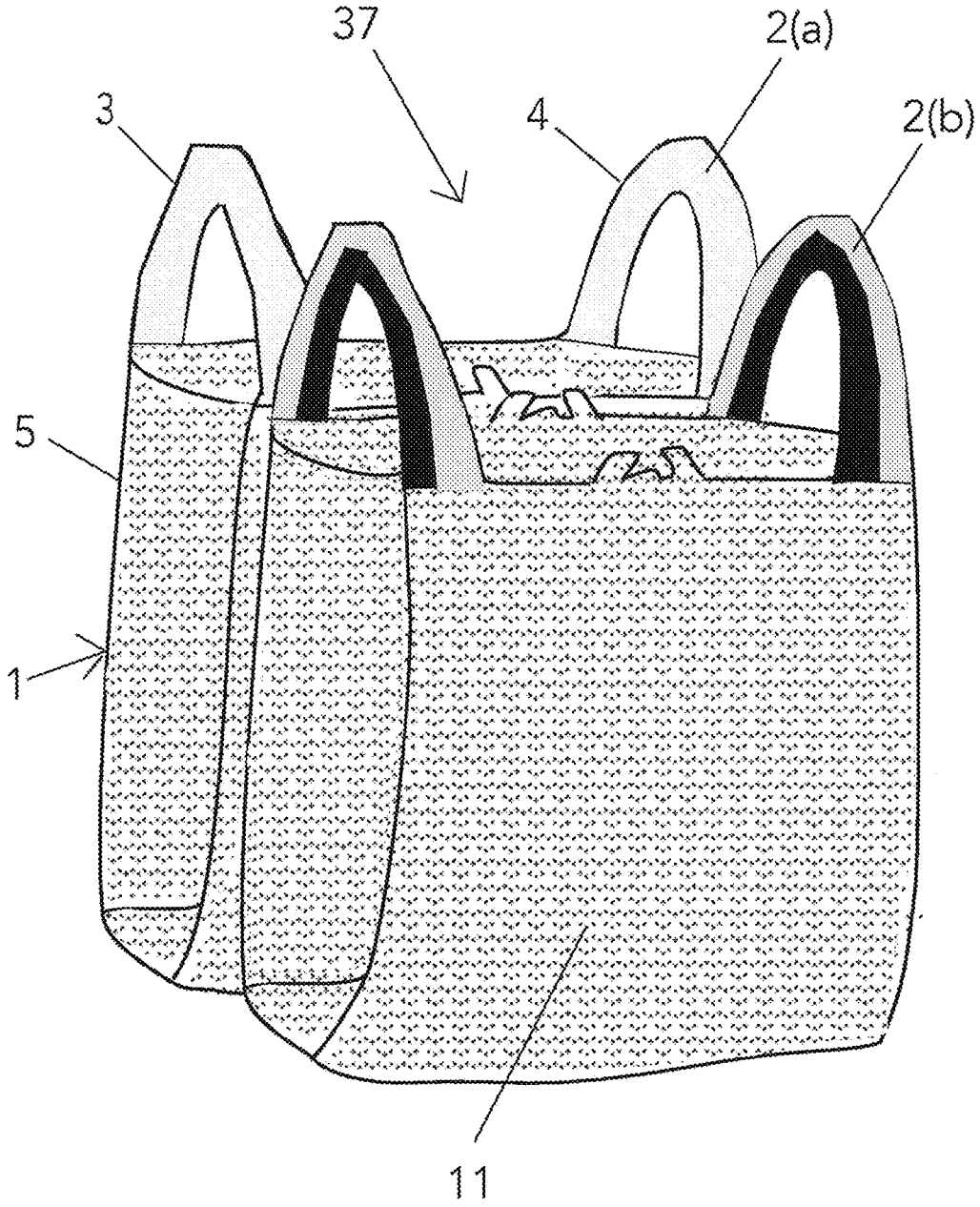
FIG. 21 shows the characteristic on the handles as a color scheme.

FIG. 21 shows a small bunch of two bags 37 showing a characteristic 2 of a color 2(*a*) on the handles 3+4 of one bag 1, while also showing a characteristic 2 of a color scheme 2(*b*) making the handles 3+4 of the bag significantly visually distinguishable from the other bag 1 handles and significantly visually distinguishable from the main body 5 of each bag 1.

What is claimed is:

1. A group of plastic bags, the group comprising:

I) multiple plastic bags wherein each plastic bag comprises:

a) a thermoplastic polymer material;

b) a structure of plastic film comprising a first end, a second end, and a continuous surrounding sidewall, the structure forms into a tubular shape having a width, a depth, and a height when the volume of the structure is filled with an amount of air or product, and the structure forming into a flattened shape when empty and collapsed;

c) the first end comprising a mouth/opening and two opposing handles, the handles being a first handle and a second handle, each handle being a loop formed integrally in and of the structure, two apertures in the structure forming the loop/handles;

d) the mouth/opening of the structure positioned between the first handle and the second handle, the mouth/opening and the handles being a top end of the bag, the opposing end of the first end being the second end and a bottom end of the bag;

e) the second end of the bag being closed and sealed with a bottom seal for holding one or more products;

f) the portion of the bag between the first end and the second end is a main body of the bag;

g) each handle comprises a distinguishing characteristic on all of, or a portion of the handle, wherein the characteristic visibly contrasts with the visual surface appearance of the main body, thereby making the handles significantly visibly distinguishable from the main body; and h) the first handle being identified with the same or similar characteristic as the second handle, thereby making the handles identifiable as a pair of handles on the same bag;

II) the bags in the group being;

a) a stack of the bags or a roll of the bags;

b) flattened, arranged and aligned in the group;

c) arranged for removal in succession from the group; and d) the group prepared for use in a dispenser rack;

III) the characteristic of the handles of the bag which is currently arranged first for removal in succession from the group differs from and is significantly visually distinguishable from the characteristic of the handles of the bag next arranged for removal in succession from the group;

IV) successive subgroups of the bags within the group of bags, wherein each subgroup can be removed from the group in succession and each bag within each subgroup can be removed from the group in succession, and wherein the characteristic of each pair of the handles of each bag within each subgroup differs from and is significantly visually distinguishable from the characteristic of every other pair of the handles of the bags in the same subgroup;

V) wherein each handle characteristic succession order and each handle characteristic in each subgroup of bags is matching and consistent with the other subgroups of bags in the same group of bags; and VI) wherein each handle characteristic in each subgroup of bags is assigned a matching numeral distinctive to the corresponding handle characteristic and the numeral is displayed in at least one of i) each corresponding handle of each pair of handles of the subgroup of bags, ii) the main body of the bag, the succession of numerals in each subgroup of bags succeeding in numerical order.

2. The group of claim 1, wherein each handle characteristic includes at least one of i) a color, ii) a color scheme, iii) a tint of a color, iv) a colored design with at least one of: a pattern; a letter; a numeral; an insignia; or v) any combination of the preceding characteristics.

3. The group of claim 1 wherein the group is the stack of bags, the group being bonded together, the main bodies of the bags being stacked one on top of another arranging into the group, and wherein the group of the stacked bags is positioned in an upright position with the handles being at the top of the bags, and the group of the upright stacked bags being aligned in parallel wherein the bottoms of all of the bags in the group are aligned with each other, and the tops of all of the bags in the group are aligned with each other, each upright bag arranged for removal in succession from the group.

4. The group of claim 1 wherein the group is the roll of bags, the group of rolled bags being arranged and aligned in series in the group wherein the bottom end of one bag is attached to or lying close to the top end of the next bag, and each bag being arranged for removal in succession from the group.

5. A system wherein the group of claim 3 or claim 4 resides in a dispenser rack.

6. A system of a cluster of stacked bags for bagging products, the cluster comprising:

a) multiple separate groups of the group of bags of claim 5, each group of the bags resides in a separate dispenser rack;

b) each group of the bags resides close in proximity to at least one other group of the bags in the cluster; and c) the handles characteristic of each bag in each group of bags comprises a distinguishing characteristic on all of or a portion of the handles that is significantly distinguishable from the characteristic of the handles of each bag in the other separate groups of bags.

7. The system of claim 6, wherein the distinguishing characteristic is different tints of a color.

8. The group of claim 3 wherein each handle comprises two handle hanger holes for hanging the handles on a dispenser rack thereby enabling both handles to support the bag in an upright position in a dispenser rack.

9. The group of claim 1, wherein each handle characteristic comprises a numeral, and the numeral is also displayed on the main body of the bag.

10. The group of claim 9, wherein the numeral displayed on the main body of the bag, is larger in size than the handle numeral.

11. The group of claim 1, wherein each handle characteristic comprises a numeral and the numeral is displayed in tactile Braille in at least one location on I) the handles, or ii) the main body, or iii) the handles and the main body of the bag in each subgroup of bags.

12. The group of claim 1, wherein a product name is displayed on each bag in at least one location on the bag.

13. The group of claim 1, wherein a picture of a product is displayed on the each bag in at least one location on the bag.

14. The group of claim 1, wherein a product identification code is displayed on each bag in at least one location on the bag.

15. A group of plastic bags, the group comprising:

I) multiple plastic bags wherein each plastic bag comprises:

a) a thermoplastic polymer material;

b) a structure of plastic film comprising a first end, a second end, and a continuous surrounding sidewall, the structure forms into a tubular shape having a width, a depth, and a height when the volume of the structure is filled with an amount of air or product, and the structure forming into a flattened shape when empty and collapsed;

c) the first end comprising a mouth/opening and two opposing handles, the handles being a first handle and a second handle, each handle being a loop formed integrally in and of the structure, two apertures in the structure forming the loop/handles;

d) the mouth/opening of the structure positioned between the first handle and the second handle, the mouth/opening and the handles being a top end of the bag, the opposing end of the first end being the second end and a bottom end of the bag;

e) the second end of the bag being closed and sealed with a bottom seal for holding one or more products;

f) the portion of the bag between the first end and the second end is a main body of the bag;

g) each handle comprises a distinguishing characteristic on all of, or a portion of the handle; and h) the first handle being identified with the same or similar characteristic as the second handle, thereby making the handles identifiable as a pair of handles on the same bag;

II) the bags in the group being;

a) a stack of the bags or a roll of the bags;

b) flattened, arranged and aligned in the group;

c) arranged for removal in succession from the group; and d) the group prepared for use in a dispenser rack;

III) the characteristic of the handles of the bag which is currently arranged first for removal in succession from the group differs from and is significantly visually distinguishable from the characteristic of the handles of the bag next arranged for removal in succession from the group;

IV) successive subgroups of the bags within the group of bags, wherein each subgroup can be removed from the group in succession and each bag within each subgroup can be removed from the group in succession, and wherein the characteristic of each pair of the handles of each bag within each subgroup differs from and is significantly visually distinguishable from the characteristic of every other pair of the handles of the bags in the same subgroup;

V) wherein each handle characteristic succession order and each handle characteristic in each subgroup of bags is matching and consistent with the other subgroups of bags in the same group of bags; and VI) wherein each handle characteristic in each subgroup of bags is assigned a matching numeral distinctive to the corresponding handle characteristic and the numeral is displayed in at least one of i) each corresponding handle of each pair of handles of the subgroup of bags, ii) the main body of the bag, the succession of numerals in each subgroup of bags succeeding in numerical order.

16. The group of claim 15, wherein each handle characteristic includes at least one of i) a color, ii) a color scheme, iii) a tint of a color, iv) a colored design with at least one of: a pattern; a letter; a numeral; an insignia; or v) any combination of the preceding characteristics.

17. The group of claim 15 wherein the group is the stack of bags, the group being bonded together, the main bodies of the bags being stacked one on top of another arranging into the group, and wherein the group of the stacked bags is positioned in an upright position with the handles being at the top of the bags, and the group of the upright stacked bags being aligned in parallel wherein the bottoms of all of the bags in the group are aligned with each other, and the tops of all of the bags in the group are aligned with each other, each upright bag arranged for removal in succession from the group.

18. The group of claim 15 wherein the group is the roll of bags, the group of rolled bags being arranged and aligned in series in the group wherein the bottom end of one bag is attached to or lying close to the top end of the next bag, and each bag being arranged for removal in succession from the group.

19. A system wherein the group of claim 17 or claim 18 resides in a dispenser rack.

20. The group of claim 15, wherein each handle characteristic comprises a numeral, and the numeral is also displayed on the main body of the bag.

21. The group of claim 20, wherein the numeral displayed on the main body of the bag is larger in size than the handle numeral.

22. The group of claim 15, wherein each handle characteristic comprises a numeral and the numeral is displayed in tactile Braille in at least one location on i) the handles, or ii) the main body, or iii) the handles and the main body of the bag in each subgroup of bags.

23. The group of claim 15 wherein the characteristic of each handle of each bag extends down into the main body of the bag.

24. The group of claim 15, wherein the mouth top opening of each bag is a mouth rim of the bag and a characteristic of the mouth rim extends down into the main body and past the mouth rim, therefore, significantly visually identifying the mouth rim of the bag, the characteristic of the mouth rim being the same characteristic as the handles characteristic.

25. The group of claim 24, wherein the mouth rim characteristic of each bag extends down into the main body of the bag for about 2.5 cm or about one inch.

26. A group of plastic bags, the group comprising:

I) multiple plastic bags wherein each plastic bag comprises:
- a) a thermoplastic polymer material;
- b) a structure of plastic film comprising a first end, a second end, and a continuous surrounding sidewall, the structure forms into a tubular shape having a width, a depth, and a height when the volume of the structure is filled with an amount of air or product, and the structure forming into a flattened shape when empty and collapsed;
- c) the first end comprising a mouth/opening and two opposing handles, the handles being a first handle and a second handle, each handle being a loop formed integrally in and of the structure, two apertures in the structure forming the loop/handles;
- d) the mouth/opening of the structure positioned between the first handle and the second handle, the mouth/opening and the handles being a top end of the bag, the opposing end of the first end being the second end and a bottom end of the bag;
- e) the second end of the bag being closed and sealed with a bottom seal for holding one or more products;
- f) the portion of the bag between the first end and the second end is a main body of the bag;
- g) each handle comprises a distinguishing characteristic on all of, or a portion of the handle, wherein the characteristic visibly contrasts with the visual surface appearance of the main body, wherein each handle characteristic includes at least one of i) a color, ii) a color scheme, iii) a tint of a color, iv) a colored design with at least one of: a pattern; a letter; a numeral; an insignia; or v) any combination of the preceding characteristics, thereby making the handles significantly visibly distinguishable from the main body; and
- h) the first handle being identified with the same or similar characteristic as the second handle, thereby making the handles identifiable as a pair of handles on the same bag;

II) the bags in the group being;
- a) a stack of the bags or a roll of the bags;
- b) flattened, arranged and aligned in the group;
- c) arranged for removal in succession from the group; and
- d) the group prepared for use in a dispenser rack;

III) the characteristic of the handles of the bag which is currently arranged first for removal in succession from the group differs from and is significantly visually distinguishable from the characteristic of the handles of the bag next arranged for removal in succession from the group;

IV) successive subgroups of the bags within the group of bags, wherein each subgroup can be removed from the group in succession and each bag within each subgroup can be removed from the group in succession, and wherein the characteristic of each pair of the handles of each bag within each subgroup differs from and is significantly visually distinguishable from the characteristic of every other pair of the handles of the bags in the same subgroup;

V) wherein each handle characteristic succession order and each handle characteristic in each subgroup of bags is matching and consistent with the other subgroups of bags in the same group of bags; and VI) wherein each handle characteristic in each subgroup of bags is assigned a matching numeral distinctive to the corresponding handle characteristic and the numeral is displayed in at least one of i) each corresponding handle of each pair of handles of the subgroup of bags, ii) the main body of the bag, the succession of numerals in each subgroup of bags succeeding in numerical order.

27. The group of claim 26 wherein the group is the stack of bags, the group being bonded together, the main bodies of the bags being stacked one on top of another arranging into the group, and wherein the group of the stacked bags is positioned in an upright position with the handles being at the top of the bags, and the group of the upright stacked bags being aligned in parallel wherein the bottoms of all of the bags in the group are aligned with each other, and the tops of all of the bags in the group are aligned with each other, each upright bag arranged for removal in succession from the group.

28. The group of claim 26 wherein the group is the roll of bags, the group of rolled bags being arranged and aligned in series in the group wherein the bottom end of one bag is attached to or lying close to the top end of the next bag, and each bag being arranged for removal in succession from the group.

29. A system wherein the group of claim 27 or claim 28 resides in a dispenser rack.

30. The group of claim 26, wherein each handle characteristic comprises a numeral, and the numeral is also displayed on the main body of the bag.

31. The group of claim 30, wherein the numeral displayed on the main body of the bag is larger in size than the handle numeral.

32. The group of claim 26, wherein each handle characteristic comprises a numeral and the numeral is displayed in tactile Braille on i) the handles, or ii) the main body, or iii) the handles and the main body of the bag in each subgroup of bags.

33. A group of plastic bags, the group comprising:

I) multiple plastic bags wherein each plastic bag comprises:

a) a thermoplastic polymer material;

b) a structure of plastic film comprising a first end, a second end, and a continuous surrounding sidewall, the structure forms into a tubular shape having a width, a depth, and a height when the volume of the structure is filled with an amount of air or product, and the structure forming into a flattened shape when empty and collapsed;

c) the first end comprising a mouth/opening and two opposing handles, the handles being a first handle and a second handle, each handle being a loop formed integrally in and of the structure, two apertures in the structure forming the loop/handles;

d) the mouth/opening of the structure positioned between the first handle and the second handle, the mouth/opening and the handles being a top end of the bag, the opposing end of the first end being the second end and a bottom end of the bag;

e) the second end of the bag being closed and sealed with a bottom seal for holding one or more products;

f) the portion of the bag between the first end and the second end is a main body of the bag;

g) each handle comprises a distinguishing characteristic on all of, or a portion of the handle, wherein each handle characteristic includes at least one of i) a color, ii) a color scheme, iii) a tint of a color, iv) a colored design with at least one of: a pattern; a letter; a numeral; an insignia; or v) any combination of the preceding characteristics; and h) the first handle being identified with the same or similar characteristic as the second handle, thereby making the handles identifiable as a pair of handles on the same bag;

II) the bags in the group being;

a) a stack of the bags or a roll of the bags;

b) flattened, arranged and aligned in the group;

c) arranged for removal in succession from the group; and d) the group prepared for use in a dispenser rack;

III) the characteristic of the handles of the bag which is currently arranged first for removal in succession from the group differs from and is significantly visually distinguishable from the characteristic of the handles of the bag next arranged for removal in succession from the group;

IV) successive subgroups of the bags within the group of bags, wherein each subgroup can be removed from the group in succession and each bag within each subgroup can be removed from the group in succession, and wherein the characteristic of each pair of the handles of each bag within each subgroup differs from and is significantly visually distinguishable from the characteristic of every other pair of the handles of the bags in the same subgroup;

V) wherein each handle characteristic succession order and each handle characteristic in each subgroup of bags is matching and consistent with the other subgroups of bags in the same group of bags; and VI) wherein each handle characteristic in each subgroup of bags is assigned a matching numeral distinctive to the corresponding handle characteristic and the numeral is displayed in at least one of i) each corresponding handle of each pair of handles of the subgroup of bags, ii) the main body of the bag, the succession of numerals in each subgroup of bags succeeding in numerical order.

34. The group of claim 33 wherein the group is the stack of bags, the group being bonded together, the main bodies of the bags being stacked one on top of another arranging into the group, and wherein the group of the stacked bags is positioned in an upright position with the handles being at the top of the bags, and the group of the upright stacked bags being aligned in parallel wherein the bottoms of all of the bags in the group are aligned with each other, and the tops of all of the bags in the group are aligned with each other, each upright bag arranged for removal in succession from the group.

35. The group of claim 33 wherein the group is the roll of bags, the group of rolled bags being arranged and aligned in series in the group wherein the bottom end of one bag is attached to or lying close to the top end of the next bag, and each bag being arranged for removal in succession from the group.

36. A system wherein the group of claim 34 or claim 35 resides in a dispenser rack.

37. The group of claim 33, wherein each handle characteristic comprises a numeral, and the numeral is also displayed on the main body of the bag.

38. The group of claim 37, wherein the numeral displayed on the main body of the bag is larger in size than the handle numeral.

39. The group of claim 33, wherein each handle characteristic comprises a numeral and the numeral is displayed in tactile Braille on i) the handles, or ii) the main body, or iii) the handles and the main body of the bag in each subgroup of bags.

40. The group of claim 33 wherein the characteristic of each handle of each bag extends down into the main body of the bag.

41. The group of claim 33, wherein the mouth top opening of each bag is a mouth rim of the bag and a characteristic of the mouth rim extends down into the main body and past the mouth rim, therefore, significantly visually identifying the mouth rim of the bag, the characteristic of the mouth rim being the same characteristic as the handles characteristic.

42. The group of claim 41, wherein the mouth rim characteristic of each bag extends down into the main body of the bag is about 2.5 cm or about one inch.

* * * * *